US009634395B2

(12) United States Patent
Kanj et al.

(10) Patent No.: US 9,634,395 B2
(45) Date of Patent: Apr. 25, 2017

(54) MONOPOLE ANTENNA WITH A TAPERED BALUN

(71) Applicant: BlackBerry Limited, Waterloo (CA)

(72) Inventors: Houssam Kanj, Waterloo (CA); Huanhuan Gu, Waterloo (CA); Christopher DeVries, St. Thomas (CA); James Warden, Fort Worth, TX (US)

(73) Assignee: BlackBerry Limited, Waterloo, Ontario (CA)

( * ) Notice: Subject to any disclaimer, the term of this patent is extended or adjusted under 35 U.S.C. 154(b) by 508 days.

(21) Appl. No.: 13/871,057

(22) Filed: Apr. 26, 2013

(65) Prior Publication Data

US 2014/0320373 A1 Oct. 30, 2014

(51) Int. Cl.

| | |
|---|---|
| ***H01Q 9/40*** | (2006.01) |
| ***H01Q 1/48*** | (2006.01) |
| ***H01Q 1/38*** | (2006.01) |

(52) U.S. Cl.

CPC ..... *H01Q 9/40* (2013.01); *H01Q 1/48* (2013.01); *H01Q 1/38* (2013.01); *Y10T 29/49016* (2015.01)

(58) Field of Classification Search

CPC ..... H01Q 9/40; H01Q 1/48; H01Q 9/0407; H01P 5/107

See application file for complete search history.

(56) References Cited

U.S. PATENT DOCUMENTS

| | | | | |
|---|---|---|---|---|
| 5,095,292 | A * | 3/1992 | Masterton | H01P 5/107 333/26 |
| 6,184,833 | B1 * | 2/2001 | Tran | H01Q 1/243 343/700 MS |
| 7,126,543 | B2 | 10/2006 | Tang et al. | |
| 2005/0259031 | A1 | 11/2005 | Sanz et al. | |
| 2006/0066487 | A1 | 3/2006 | Park et al. | |
| 2006/0158383 | A1 | 7/2006 | Kwon et al. | |
| 2007/0030199 | A1 * | 2/2007 | Chen | H01Q 1/362 343/700 MS |
| 2008/0198084 | A1 | 8/2008 | Yeap | |

(Continued)

FOREIGN PATENT DOCUMENTS

| | | | |
|---|---|---|---|
| EP | 2079130 | A1 | 7/2009 |
| GB | 2439110 | A | 12/2007 |
| WO | 9708774 | | 3/1997 |
| WO | 02093690 | A1 | 11/2002 |

OTHER PUBLICATIONS

Bo Pan et al , "A 60-GHz CPW-Fed High-Gain and Broadband Integrated Horn Antenna", IEEE Transactions on Antennas and Propagation, vol. 57, No. 4, Apr. 2009, 7 Pages.

(Continued)

*Primary Examiner* — Graham Smith
*Assistant Examiner* — Daniel J Munoz
(74) *Attorney, Agent, or Firm* — Conley Rose, P.C.; J. Robert Brown, Jr.; Albert A. Abbou

(57) ABSTRACT

Embodiments are directed to a balun structure comprising: a monopole antenna, and a microstrip coupled to the monopole antenna and comprising a ground plane modified to include at least two arms. Embodiments are directed to a balun structure comprising: a monopole antenna, and a microstrip coupled to the monopole antenna using a stepwise tapered microstrip feed.

19 Claims, 24 Drawing Sheets

(56) References Cited

U.S. PATENT DOCUMENTS

| | | | | |
|---|---|---|---|---|
| 2008/0266190 | A1* | 10/2008 | Ohba | H01Q 1/243 343/702 |
| 2009/0009400 | A1* | 1/2009 | Kim | H01Q 1/521 343/700 MS |
| 2010/0214188 | A1* | 8/2010 | Furutani | H01Q 1/2225 343/793 |
| 2011/0063053 | A1* | 3/2011 | Guler | H01Q 9/285 333/21 R |
| 2012/0050125 | A1* | 3/2012 | Leiba | H01Q 1/2283 343/834 |
| 2014/0168028 | A1* | 6/2014 | Yanagi | H01Q 1/38 343/848 |

OTHER PUBLICATIONS

European Patent Office Search Report for Application 13165522.7, mailed Apr. 11, 2013, 7 Pages.

Constantinescu, Stefan, "Panasonic shoves WiGig inside mobile phones, expect multi gigabit per second transfer speeds", IntoMobile, Jun. 6, 2011, 4 pages. Located at http://www.intomobile.com/2011/06106/panasonic-shoves-wigig-inside-mobile-phones-expect-multi-gigabit-per-second-transfer-speeds/.

The Portable Multimedia Blog, "World's first notebook PC with integrated 60GHz wireless HD", Jun. 1, 2010. Located at http://portablemultimedia.blogspot.ca/2010/06/worlds-first-notebook-pc-with.html, 6 pages.

Smith, Tony , "Qualcomm chip puts 60GHZ wireless gigabit into Dell Ultrabook WiGig delivered through Wi-Fi kit", The Register, located at: http://www.theregister.co.uk/2012/11/01/qualcomm_chip_puts_wigig_into_dell_ultrabook/, Nov. 1, 2012, 1 page.

WiGig, WiGig White Paper, "Defining the Future of Multi-Gigabit Wireless Communications", Jul. 2010, pp. 1-5.

Wireless Gigabit Alliance, Wikipedia, located at http://en.wikipedia.org/wiki/Wireless_Gigabit_Alliance, Mar. 21, 2013, 5 pages.

* cited by examiner

MONOPOLE ANTENNA WITH A TAPERED BALUN

BACKGROUND

Spectrum around 60 GHz has attracted interest in connection with communication systems. For example, 60 GHz communication may facilitate a large communication bandwidth and higher data rates relative to lower frequencies of operation (e.g., WiFi). Also, the shorter wavelength in 60 GHz based systems allows for small antenna dimensions that enable multiple antenna systems, such as phased arrays.

The 60 GHz antenna form factor is on the order of millimeters, which requires advanced integration techniques for packaging. Routing signals from a chipset source to an antenna is also problematic. There may also be competing requirements between the antenna and the support circuitry. For example, the antenna may need a substrate with low permittivity and high relative thickness to obtain the greatest efficiency, a wide bandwidth, an undisturbed radiation pattern, and less coupling to other components. Conversely, the radio frequency (RF) components may require thin materials with high permittivity for compactness, better signal transmission, and better thermal dissipation.

There are various types of antennas. In a 60 GHz based system, it may be beneficial to have antennas that are omnidirectional. A typical example is a printed planar monopole antenna fed with a microstrip transmission line. However, since the wavelength is short, at 60 GHz for an off package antenna, the microstrip line length could be on the order of a wavelength. Then, if the transmission line is unbalanced, strong radiation may come from the transmission line itself.

A monopole antenna may suffer from a strong current balancing problem. Usually, a balanced feed (Balun) needs to be designed to ensure that the distribution of current in the ground and the microstrip transmission line do not cause radiation problems.

BRIEF DESCRIPTION OF THE DRAWINGS

The present disclosure may be understood, and its numerous objects, features and advantages obtained, when the following detailed description is considered in conjunction with the following drawings, in which.

DETAILED DESCRIPTION

Figure 1:
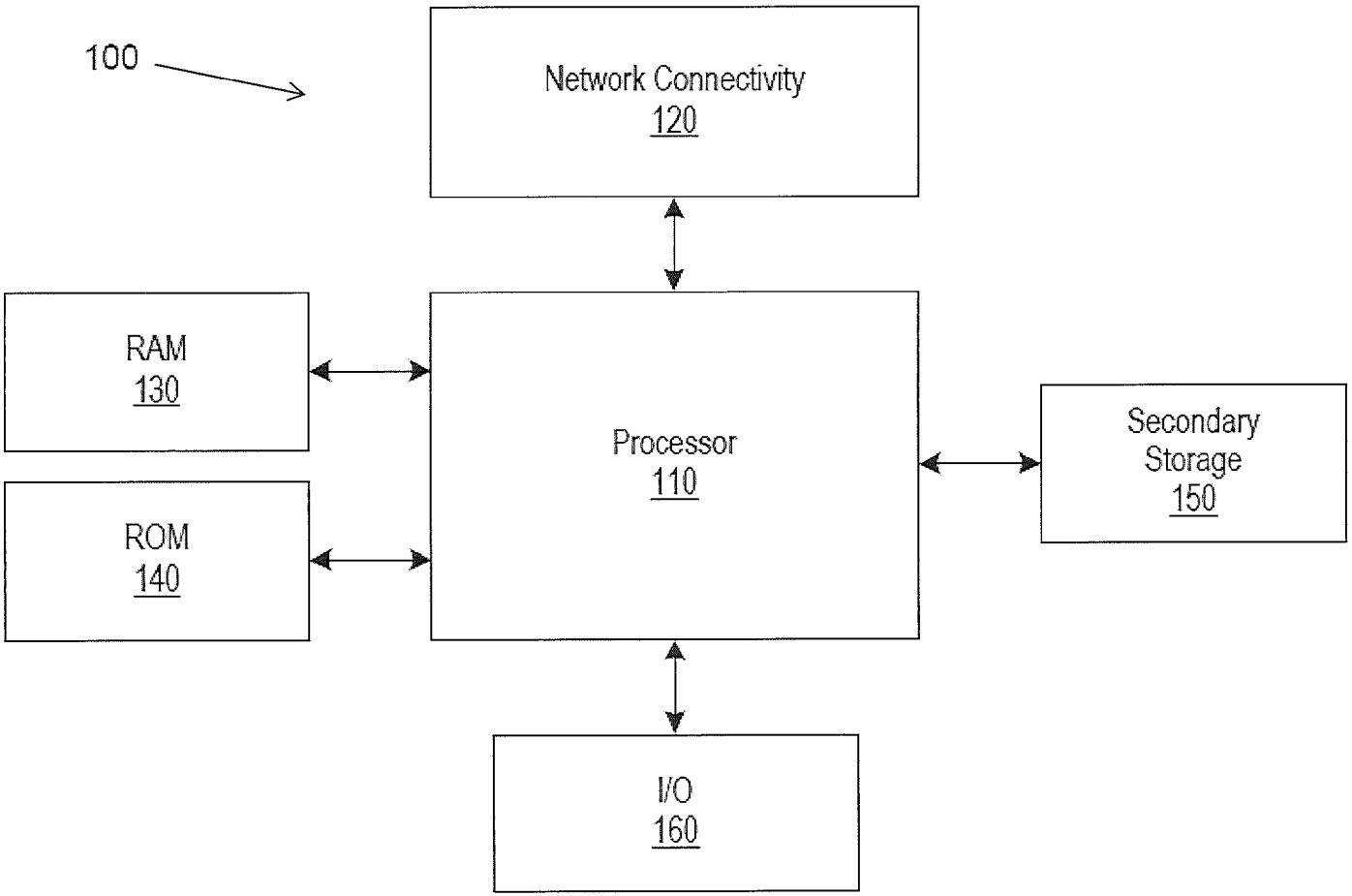
FIG. 1 depicts an exemplary system in which the present disclosure may be implemented.

The present disclosure is directed in general to communications systems and methods for operating the same.

Embodiments are directed to a balun structure comprising: a monopole antenna, and a microstrip coupled to the monopole antenna and comprising a ground plane modified to include at least two arms.

Embodiments are directed to a balun structure comprising: a monopole antenna, and a microstrip coupled to the monopole antenna using a stepwise tapered microstrip feed.

Embodiments are directed to a method comprising: modifying a ground plane of a microstrip to include at least two arms, and coupling the microstrip to a monopole antenna.

Various illustrative embodiments of the present disclosure will now be described in detail with reference to the accompanying figures. While various details are set forth in the following description, it will be appreciated that the present disclosure may be practiced without these specific details, and that numerous implementation-specific decisions may be made to the disclosure described herein to achieve specific goals, such as compliance with process technology or design-related constraints, which will vary from one implementation to another. While such a development effort might be complex and time-consuming, it would nevertheless be a routine undertaking for those of skill in the art having the benefit of this disclosure. For example, selected aspects are shown in block diagram and flowchart form, rather than in detail, in order to avoid limiting or obscuring the present disclosure. In addition, some portions of the detailed descriptions provided herein are presented in terms of algorithms or operations on data within a computer memory. Such descriptions and representations are used by those skilled in the art to describe and convey the substance of their work to others skilled in the art.

As used herein, the terms "component," "system" and the like are intended to refer to a computer-related entity, either hardware, software, a combination of hardware and software, or software in execution. For example, a component may be, but is not limited to being, a processor, a process running on a processor, an object, an executable instruction sequence, a thread of execution, a program, or a computer. By way of illustration, both an application running on a computer and the computer itself can be a component. One or more components may reside within a process or thread of execution and a component may be localized on one computer or distributed between two or more computers.

As likewise used herein, the term "node" broadly refers to a connection point, such as a redistribution point or a communication endpoint, of a communication environment, such as a network. Accordingly, such nodes refer to an active electronic device capable of sending, receiving, or forwarding information over a communications channel. Examples of such nodes include data circuit-terminating equipment (DCE), such as a modem, hub, bridge or switch, and data terminal equipment (DTE), such as a handset, a printer or a host computer (e.g., a router, workstation or server). Examples of local area network (LAN) or wide area network (WAN) nodes include computers, packet switches, cable modems, Data Subscriber Line (DSL) modems, and wireless LAN (WLAN) access points. Examples of Internet or Intranet nodes include host computers identified by an Internet Protocol (IP) address, bridges and WLAN access points. Likewise, examples of nodes in cellular communication include base stations, relays, base station controllers, radio network controllers, home location registers (HLR), visited location registers (VLR), Gateway GPRS Support Nodes (GGSN), Serving GPRS Support Nodes (SGSN), Serving Gateways (S-GW), and Packet Data Network Gateways (PDN-GW).

Other examples of nodes include client nodes, server nodes, peer nodes and access nodes. As used herein, a client node may refer to wireless devices such as mobile telephones, smart phones, personal digital assistants (PDAs), handheld devices, portable computers, tablet computers, and similar devices or other user equipment (UE) that has telecommunications capabilities. Such client nodes may likewise refer to a mobile, wireless device, or alternatively, to devices that have similar capabilities that are not generally transportable, such as desktop computers, set-top boxes, or sensors. A network node, as used herein, generally includes all nodes with the exception of client nodes, server nodes and access nodes. Likewise, a server node, as used herein, refers to an information processing device (e.g., a host computer), or series of information processing devices, that perform information processing requests submitted by other nodes. As likewise used herein, a peer node may sometimes serve as client node, and at other times, a server node. In a peer-to-peer or overlay network, a node that actively routes data for other networked devices as well as itself may be referred to as a supernode.

An access node, as used herein, refers to a node that provides a client node access to a communication environment. Examples of access nodes include cellular network base stations and wireless broadband (e.g., WiFi, WiMAX, etc.) access points, which provide corresponding cell and WLAN coverage areas. WiGig® and its equivalents in the greater than 50 GHz range are also examples of wireless broadband. As used herein, a macrocell is used to generally describe a traditional cellular network cell coverage area. Such macrocells are typically found in rural areas, along highways, or in less populated areas. As likewise used herein, a microcell refers to a cellular network cell with a smaller coverage area than that of a macrocell. Such micro cells are typically used in a densely populated urban area. Likewise, as used herein, a picocell refers to a cellular network coverage area that is less than that of a microcell. An example of the coverage area of a picocell may be a large office, a shopping mall, or a train station. A femtocell, as used herein, currently refers to the smallest commonly accepted area of cellular network coverage. As an example, the coverage area of a femtocell is sufficient for homes or small offices.

In general, a coverage area of less than two kilometers typically corresponds to a microcell, 200 meters or less for a picocell, and on the order of 10 meters for a femtocell. The actual dimensions of the cell may depend on the radio frequency of operation, the radio propagation conditions and the density of communications traffic. As likewise used herein, a client node communicating with an access node associated with a macrocell is referred to as a "macrocell client." Likewise, a client node communicating with an access node associated with a microcell, picocell, or femtocell is respectively referred to as a "microcell client," "picocell client," or "femtocell client."

The term "article of manufacture" (or alternatively, "computer program product") as used herein is intended to encompass a computer program accessible from any computer-readable device or media. For example, computer readable media can include but are not limited to magnetic storage devices (e.g., hard disk, floppy disk, magnetic strips, etc.), optical disks such as a compact disk (CD) or digital versatile disk (DVD), smart cards, and flash memory devices (e.g., card, stick, etc.).

The word "exemplary" is used herein to mean serving as an example, instance, or illustration. Any aspect or design described herein as "exemplary" is not necessarily to be construed as preferred or advantageous over other aspects or designs. Those of skill in the art will recognize many modifications may be made to this configuration without departing from the scope, spirit or intent of the claimed subject matter. Furthermore, the disclosed subject matter may be implemented as a system, method, apparatus, or article of manufacture using standard programming and engineering techniques to produce software, firmware, hardware, or any combination thereof to control a computer or processor-based device to implement aspects detailed herein.

FIG. 1 illustrates an example of a system 100 suitable for implementing one or more embodiments disclosed herein. In various embodiments, the system 100 comprises a processor 110, which may be referred to as a central processor unit (CPU) or digital signal processor (DSP), network connectivity interfaces 120, random access memory (RAM) 130, read only memory (ROM) 140, secondary storage 150, and input/output (I/O) devices 160. In some embodiments, some of these components may not be present or may be combined in various combinations with one another or with other components not shown. These components may be located in a single physical entity or in more than one physical entity. Any actions described herein as being taken by the processor 110 might be taken by the processor 110 alone or by the processor 110 in conjunction with one or more components shown or not shown in FIG. 1.

The processor 110 executes instructions, codes, computer programs, or scripts that it might access from the network connectivity interfaces 120, RAM 130, or ROM 140. While only one processor 110 is shown, multiple processors may be present. Thus, while instructions may be discussed as being executed by a processor 110, the instructions may be executed simultaneously, serially, or otherwise by one or multiple processors 110 implemented as one or more CPU chips.

In various embodiments, the network connectivity interfaces 120 may take the form of modems, modem banks, Ethernet devices, universal serial bus (USB) interface devices, serial interfaces, token ring devices, fiber distributed data interface (FDDI) devices, wireless local area network (WLAN) devices (including radio, optical or infrared signals), radio transceiver devices such as code division multiple access (CDMA) devices, global system for mobile communications (GSM) radio transceiver devices, long term evolution (LTE) radio transceiver devices, worldwide interoperability for microwave access (WiMAX) devices, and/or other well-known interfaces for connecting to networks, including Personal Area Networks (PANs) such as Bluetooth. These network connectivity interfaces 120 may enable the processor 110 to communicate with the Internet or one or more telecommunications networks or other networks from which the processor 110 might receive information or to which the processor 110 might output information.

The network connectivity interfaces 120 may also be capable of transmitting or receiving data wirelessly in the form of electromagnetic waves, such as radio frequency signals or microwave frequency signals. Information transmitted or received by the network connectivity interfaces 120 may include data that has been processed by the processor 110 or instructions that are to be executed by processor 110. The data may be ordered according to different sequences as may be desirable for either processing or generating the data or transmitting or receiving the data.

In various embodiments, the RAM 130 may be used to store volatile data and instructions that are executed by the processor 110. The ROM 140 shown in FIG. 1 may likewise be used to store instructions and data that is read during execution of the instructions. The secondary storage 150 is typically comprised of one or more disk drives, solid state drives, or tape drives and may be used for non-volatile storage of data or as an overflow data storage device if RAM 130 is not large enough to hold all working data. Secondary storage 150 may likewise be used to store programs that are loaded into RAM 130 when such programs are selected for execution. The I/O devices 160 may include liquid crystal displays (LCDs), Light Emitting Diode (LED) displays, Organic Light Emitting Diode (OLED) displays, projectors, televisions, touch screen displays, keyboards, keypads, switches, dials, mice, track balls, track pads, voice recognizers, card readers, paper tape readers, printers, video monitors, or other well-known input/output devices.

Figure 2:
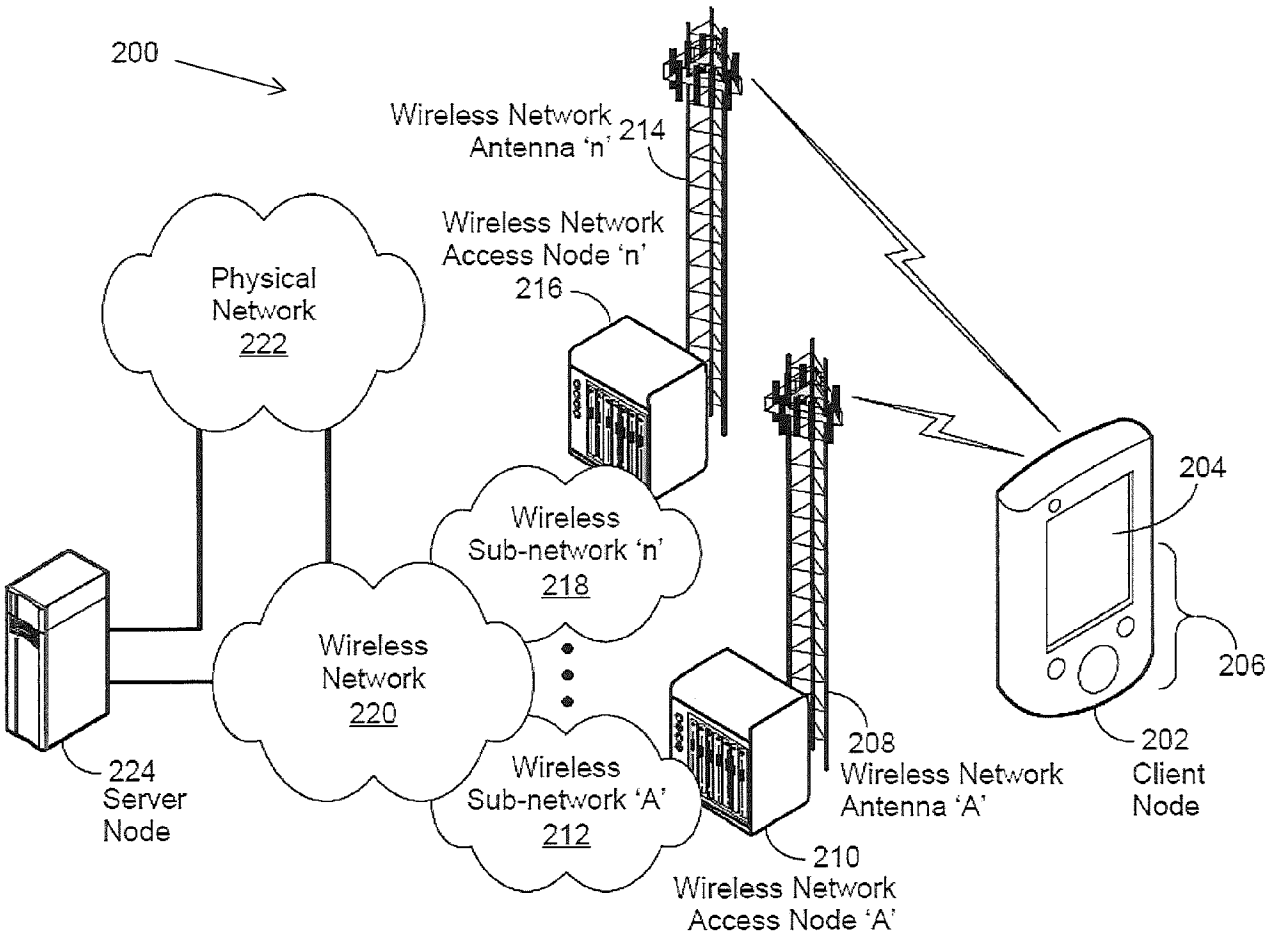
FIG. 2 shows a wireless-enabled communications environment including an embodiment of a client node.

FIG. 2 shows a wireless-enabled communications environment including an embodiment of a client node as implemented in an embodiment of the disclosure. Though illustrated as a mobile phone, the client node 202 may take various forms including a wireless handset, a pager, a smart phone, or a personal digital assistant (PDA). In various embodiments, the client node 202 may also comprise a portable computer, a tablet computer, a laptop computer, or any computing device operable to perform data communication operations. Many suitable devices combine some or all of these functions. In some embodiments, the client node 202 is not a general purpose computing device like a portable, laptop, or tablet computer, but rather is a special-purpose communications device such as a telecommunications device installed in a vehicle. The client node 202 may likewise be a device, include a device, or be included in a device that has similar capabilities but that is not transportable, such as a desktop computer, a set-top box, or a network node. In these and other embodiments, the client node 202 may support specialized activities such as gaming, inventory control, job control, task management functions, and so forth.

In various embodiments, the client node 202 includes a display 204. In these and other embodiments, the client node 202 may likewise include a touch-sensitive surface, a keyboard or other input keys 206 generally used for input by a user. The input keys 206 may likewise be a full or reduced alphanumeric keyboard such as QWERTY, DVORAK, AZERTY, and sequential keyboard types, or a traditional numeric keypad with alphabet letters associated with a telephone keypad. The input keys 206 may likewise include a trackwheel, an exit or escape key, a trackball, trackpad, touch sensitive input device and other navigational or functional keys, which may be moved to different positions, e.g., inwardly depressed, to provide further input function. The client node 202 may likewise present options for the user to select, controls for the user to actuate, and cursors or other indicators for the user to direct.

The client node 202 may further accept data entry from the user, including numbers to dial or various parameter values for configuring the operation of the client node 202. The client node 202 may further execute one or more software or firmware applications in response to user commands. These applications may configure the client node 202 to perform various customized functions in response to user interaction. Additionally, the client node 202 may be programmed or configured over-the-air (OTA), for example from a wireless network access node 'A' 210 through 'n' 216 (e.g., a base station), a server node 224 (e.g., a host computer), or a peer client node 202.

Among the various applications executable by the client node 202 are a web browser, which enables the display 204 to display a web page. The web page may be obtained from a server node 224 through a wireless connection with a wireless network 220. As used herein, a wireless network 220 broadly refers to any network using at least one wireless connection between two of its nodes. The various applications may likewise be obtained from a peer client node 202 or other system over a connection to the wireless network 220 or any other wirelessly-enabled communication network or system.

In various embodiments, the wireless network 220 comprises a plurality of wireless sub-networks (e.g., cells with corresponding coverage areas) 'A' 212 through 'n' 218. As used herein, the wireless sub-networks 'A' 212 through 'n' 218 may variously comprise a mobile wireless access network or a fixed wireless access network. In these and other embodiments, the client node 202 transmits and receives communication signals, which are respectively communicated to and from the wireless network nodes 'A' 210 through 'n' 216 by wireless network antennas 'A' 208 through 'n' 214 (e.g., cell towers). In turn, the communication signals are used by the wireless network access nodes 'A' 210 through 'n' 216 to establish a wireless communication session with the client node 202. As used herein, the network access nodes 'A' 210 through 'n' 216 broadly refer to any access node of a wireless network. As shown in FIG. 2, the wireless network access nodes 'A' 210 through 'n' 216 are respectively coupled to wireless sub-networks 'A' 212 through 'n' 218, which are in turn connected to the wireless network 220.

In various embodiments, the wireless network 220 is coupled to a core network 222, e.g., a global computer network such as the Internet. Via the wireless network 220 and the core network 222, the client node 202 has access to information on various hosts, such as the server node 224. In these and other embodiments, the server node 224 may provide content that may be shown on the display 204 or used by the client node processor 110 for its operations. Alternatively, the client node 202 may access the wireless network 220 through a peer client node 202 acting as an intermediary, in a relay type or hop type of connection. As another alternative, the client node 202 may be tethered and obtain its data from a linked device that is connected to the wireless sub-network 212. Skilled practitioners of the art will recognize that many such embodiments are possible and the foregoing is not intended to limit the spirit, scope, or intention of the disclosure.

Figure 3:
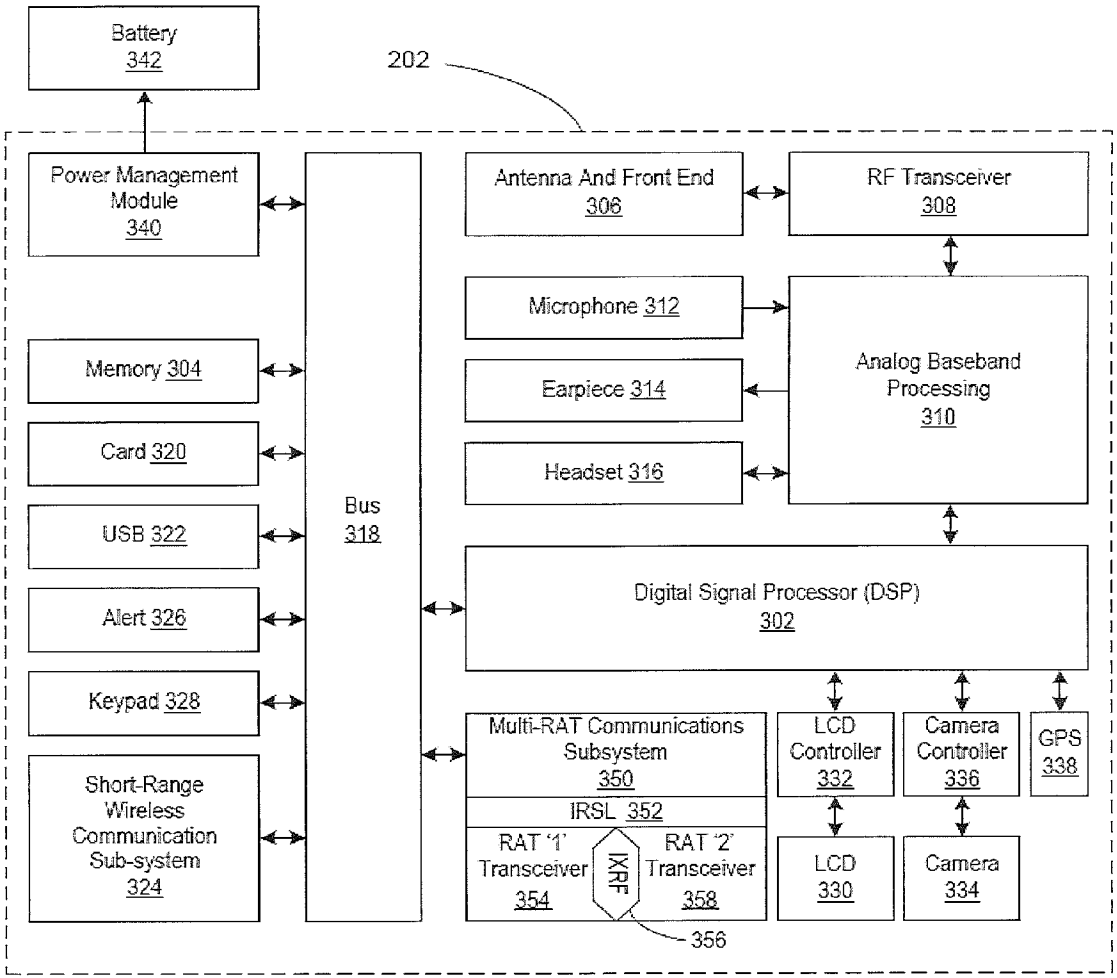
FIG. 3 is a simplified block diagram of an exemplary client node comprising a digital signal processor (DSP)

FIG. 3 depicts a block diagram of an exemplary client node as implemented with a digital signal processor (DSP) in accordance with an embodiment of the disclosure. While various components of a client node 202 are depicted, various embodiments of the client node 202 may include a subset of the listed components or additional components not listed. As shown in FIG. 3, the client node 202 includes a DSP 302 and a memory 304. As shown, the client node 202 may further include an antenna and front end unit 306, a radio frequency (RF) transceiver 308, an analog baseband processing unit 310, a microphone 312, an earpiece speaker 314, a headset port 316, a bus 318, such as a system bus or an input/output (I/O) interface bus, a removable memory card 320, a universal serial bus (USB) port 322, a short range wireless communication sub-system 324, an alert 326, a keypad 328, a liquid crystal display (LCD) 330, which may include a touch sensitive surface, an LCD controller 332, a charge-coupled device (CCD) camera 334, a camera controller 336, and a global positioning system (GPS) sensor 338, and a power management module 340 operably coupled to a power storage unit, such as a battery 342. In various embodiments, the client node 202 may include another kind of display that does not provide a touch sensitive screen. In one embodiment, the DSP 302 communicates directly with the memory 304 without passing through the input/output interface ("Bus") 318.

In various embodiments, the DSP 302 or some other form of controller or central processing unit (CPU) operates to control the various components of the client node 202 in accordance with embedded software or firmware stored in memory 304 or stored in memory contained within the DSP 302 itself. In addition to the embedded software or firmware, the DSP 302 may execute other applications stored in the memory 304 or made available via information media such as portable data storage media like the removable memory card 320 or via wired or wireless network communications. The application software may comprise a compiled set of machine-readable instructions that configure the DSP 302 to provide the desired functionality, or the application software may be high-level software instructions to be processed by an interpreter or compiler to indirectly configure the DSP 302.

The antenna and front end unit 306 may be provided to convert between wireless signals and electrical signals, enabling the client node 202 to send and receive information from a cellular network or some other available wireless communications network or from a peer client node 202. In an embodiment, the antenna and front end unit 106 may include multiple antennas to support beam forming and/or multiple input multiple output (MIMO) operations. As is known to those skilled in the art, MIMO operations may provide spatial diversity, which can be used to overcome difficult channel conditions or to increase channel throughput. Likewise, the antenna and front-end unit 306 may include antenna tuning or impedance matching components, RF power amplifiers, or low noise amplifiers.

In various embodiments, the RF transceiver 308 provides frequency shifting, converting received RF signals to baseband and converting baseband transmit signals to RF. In some descriptions a radio transceiver or RF transceiver may be understood to include other signal processing functionality such as modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions. For the purposes of clarity, the description here separates the description of this signal processing from the RF and/or radio stage and conceptually allocates that signal processing to the analog baseband processing unit 310 or the DSP 302 or other central processing unit. In some embodiments, the RF Transceiver 108, portions of the Antenna and Front End 306, and the analog base band processing unit 310 may be combined in one or more processing units and/or application specific integrated circuits (ASICs).

Note that in this diagram the radio access technology (RAT) RAT1 and RAT2 transceivers 354, 358, the IXRF 356, the IRSL 352 and Multi-RAT subsystem 350 are operably coupled to the RF transceiver 308 and analog baseband processing unit 310 and then also coupled to the antenna and front end 306 via the RF transceiver 308. As there may be multiple RAT transceivers, there will typically be multiple antennas or front ends 306 or RF transceivers 308, one for each RAT or band of operation.

The analog baseband processing unit 310 may provide various analog processing of inputs and outputs for the RF transceivers 308 and the speech interfaces (312, 314, 316). For example, the analog baseband processing unit 310 receives inputs from the microphone 312 and the headset 316 and provides outputs to the earpiece 314 and the headset 316. To that end, the analog baseband processing unit 310 may have ports for connecting to the built-in microphone 312 and the earpiece speaker 314 that enable the client node 202 to be used as a cell phone. The analog baseband processing unit 310 may further include a port for connecting to a headset or other hands-free microphone and speaker configuration. The analog baseband processing unit 310 may provide digital-to-analog conversion in one signal direction and analog-to-digital conversion in the opposing signal direction. In various embodiments, at least some of the functionality of the analog baseband processing unit 310 may be provided by digital processing components, for example by the DSP 302 or by other central processing units.

The DSP 302 may perform modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions associated with wireless communications. In an embodiment, for example in a code division multiple access (CDMA) technology application, for a transmitter function the DSP 302 may perform modulation, coding, interleaving, and spreading, and for a receiver function the DSP 302 may perform despreading, deinterleaving, decoding, and demodulation. In another embodiment, for example in an orthogonal frequency division multiplex access (OFDMA) technology application, for the transmitter function the DSP 302 may perform modulation, coding, interleaving, inverse fast Fourier transforming, and cyclic prefix appending, and for a receiver function the DSP 302 may perform cyclic prefix removal, fast Fourier transforming, deinterleaving, decoding, and demodulation.

In other wireless technology applications, yet other signal processing functions and combinations of signal processing functions may be performed by the DSP 302.

The DSP 302 may communicate with a wireless network via the analog baseband processing unit 310. In some embodiments, the communication may provide Internet connectivity, enabling a user to gain access to content on the Internet and to send and receive e-mail or text messages. The input/output interface 318 interconnects the DSP 302 and various memories and interfaces. The memory 304 and the removable memory card 320 may provide software and data to configure the operation of the DSP 302. Among the interfaces may be the USB interface 322 and the short range wireless communication sub-system 324. The USB interface 322 may be used to charge the client node 202 and may also enable the client node 202 to function as a peripheral device to exchange information with a personal computer or other computer system. The short range wireless communication sub-system 324 may include an infrared port, a Bluetooth interface, an IEEE 802.11 compliant wireless interface, or any other short range wireless communication sub-system, which may enable the client node 202 to communicate wirelessly with other nearby client nodes and access nodes. The short-range wireless communication Sub-system 324 may also include suitable RF Transceiver, Antenna and Front End subsystems.

The input/output interface ("Bus") 318 may further connect the DSP 302 to the alert 326 that, when triggered, causes the client node 202 to provide a notice to the user, for example, by ringing, playing a melody, or vibrating. The alert 326 may serve as a mechanism for alerting the user to any of various events such as an incoming call, a new text message, and an appointment reminder by silently vibrating, or by playing a specific pre-assigned melody for a particular caller.

The keypad 328 couples to the DSP 302 via the I/O interface ("Bus") 318 to provide one mechanism for the user to make selections, enter information, and otherwise provide input to the client node 202. The keyboard 328 may be a full or reduced alphanumeric keyboard such as QWERTY, DVORAK, AZERTY and sequential types, or a traditional numeric keypad with alphabet letters associated with a telephone keypad. The input keys may likewise include a trackwheel, track pad, an exit or escape key, a trackball, and other navigational or functional keys, which may be inwardly depressed to provide further input function. Another input mechanism may be the LCD 330, which may include touch screen capability and also display text and/or graphics to the user. The LCD controller 332 couples the DSP 302 to the LCD 330.

The CCD camera 334, if equipped, enables the client node 202 to make digital pictures. The DSP 302 communicates with the CCD camera 334 via the camera controller 336. In another embodiment, a camera operating according to a technology other than Charge Coupled Device cameras may be employed. The GPS sensor 338 is coupled to the DSP 302 to decode global positioning system signals or other navigational signals, thereby enabling the client node 202 to determine its position. The GPS sensor 338 may be coupled to an antenna and front end (not shown) suitable for its band of operation. Various other peripherals may also be included to provide additional functions, such as radio and television reception.

In various embodiments, the client node (e.g., 202) comprises a first Radio Access Technology (RAT) transceiver 354 and a second RAT transceiver 358. As shown in FIG. 3, and described in greater detail herein, the RAT transceivers '1' 354 and '2' 358 are in turn coupled to a multi-RAT communications subsystem 350 by an Inter-RAT Supervisory Layer Module 352. In turn, the multi-RAT communications subsystem 350 is operably coupled to the Bus 318. Optionally, the respective radio protocol layers of the first Radio Access Technology (RAT) transceiver 354 and the second RAT transceiver 358 are operably coupled to one another through an Inter-RAT eXchange Function (IRXF) Module 356.

In various embodiments, the network node (e.g. 224) acting as a server comprises a first communication link corresponding to data to/from the first RAT and a second communication link corresponding to data to/from the second RAT.

Embodiments of the disclosure may also include a housing in which the components of FIG. 3 are secured. In an example, the antenna, which can be part of the antenna and front end 306, is positioned in the housing. The antenna might not be readily visible or distinguishable from the housing. One or more slots may be available in the housing to support the antenna. In an example, the antenna can be mostly positioned in the side of the housing. In an example, the antenna can be at least partially positioned in a trackpad, display, or touchscreen of a device (e.g., a mobile device).

Embodiments of the disclosure may be operative at one or more frequencies. For example, communication may occur at 60 GHz (which may be divided into one or more channels or bands, such as a first channel between 57.24 GHz and 59.4 GHz, a second channel between 59.4 GHz and 61.56 GHz, a third channel between 61.56 GHz and 63.72 GHz, and a fourth channel between 63.72 GHz and 65.88 GHz). In some embodiments, an antenna may achieve communication in a range of 60 GHZ, +/−5 GHz or +/−6 GHz.

Embodiments of the disclosure are directed to one or more systems, apparatuses, devices, and methods for making and using a Balun structure for a 60 GHz monopole antenna. In some embodiments, a stepwise tapered feed may be used to improve matching. A monopole antenna may demonstrate enhanced balancing relative to conventional designs while retaining an omnidirectional radiation pattern.

Figure 4A:
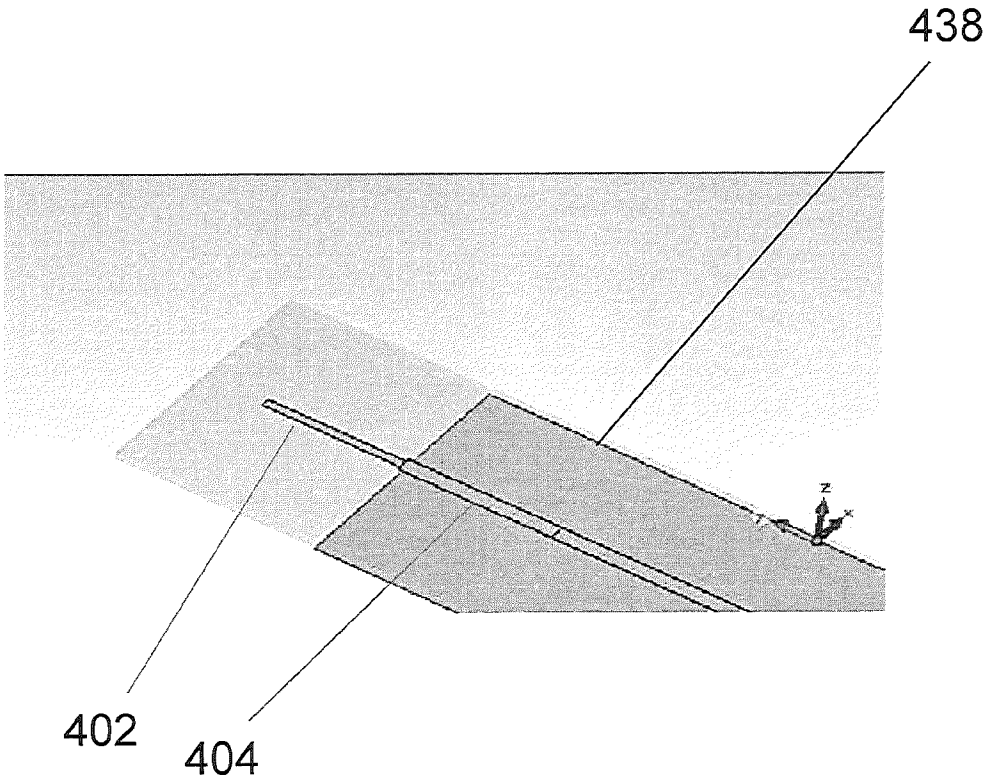
FIG. 4A illustrates a monopole antenna fed by a microstrip line.
Figure 4B:
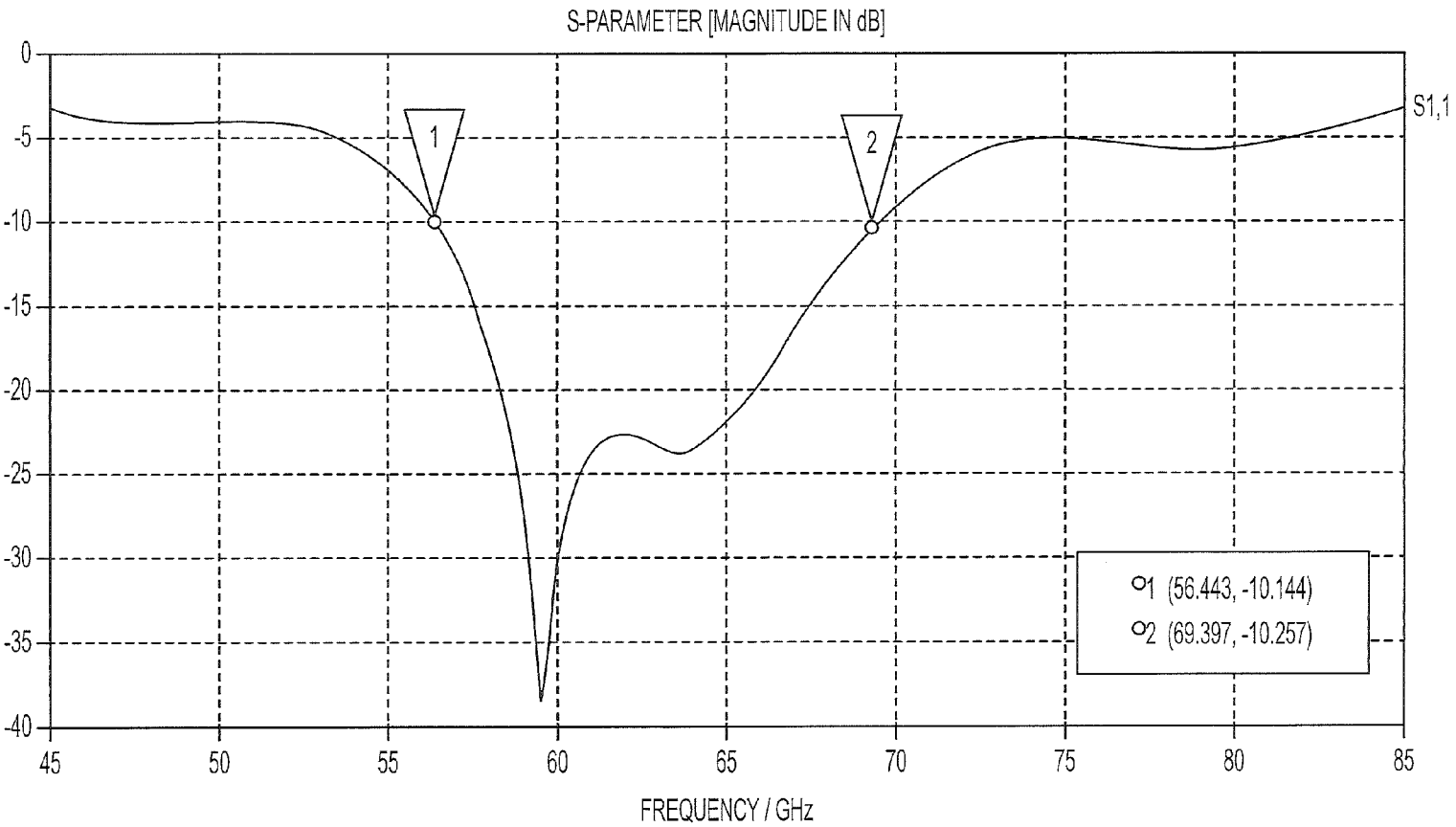
FIG. 4B illustrates a S11 reflection coefficient for the monopole antenna of FIG. 4A.
Figure 4C:
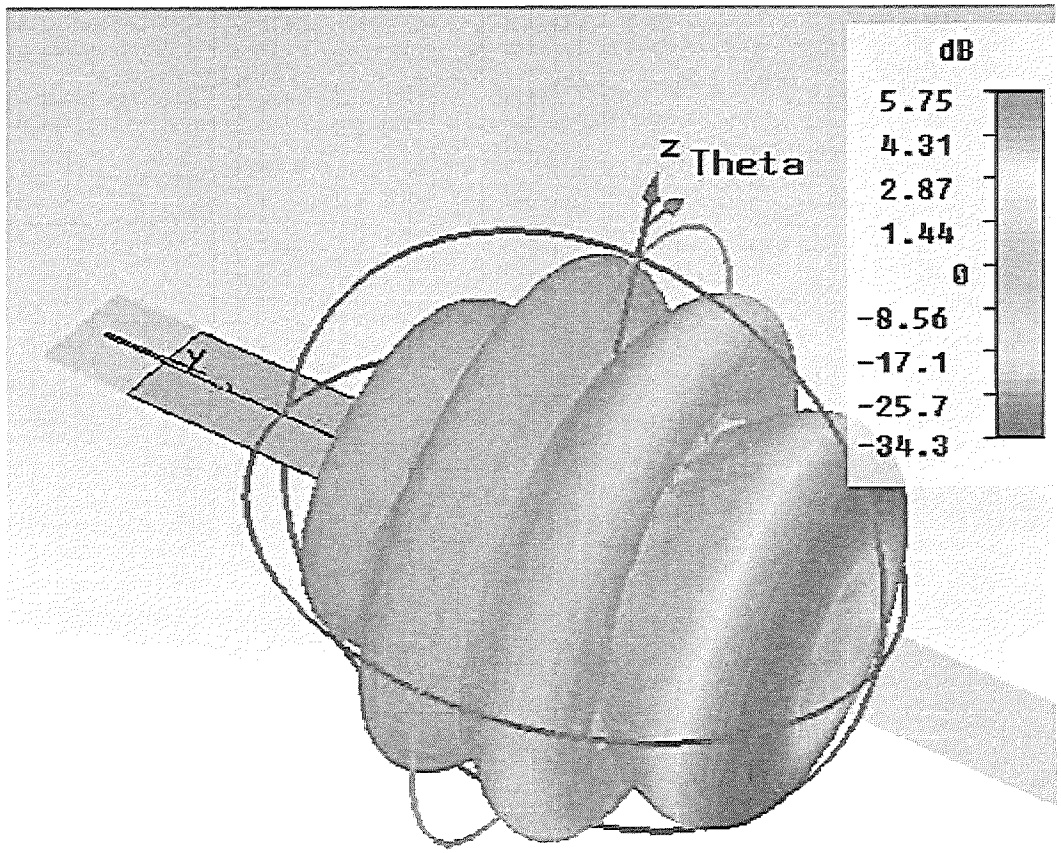
FIG. 4C illustrates a three-dimensional (3D) radiation pattern for the monopole antenna of FIG. 4A.
Figure 4D:
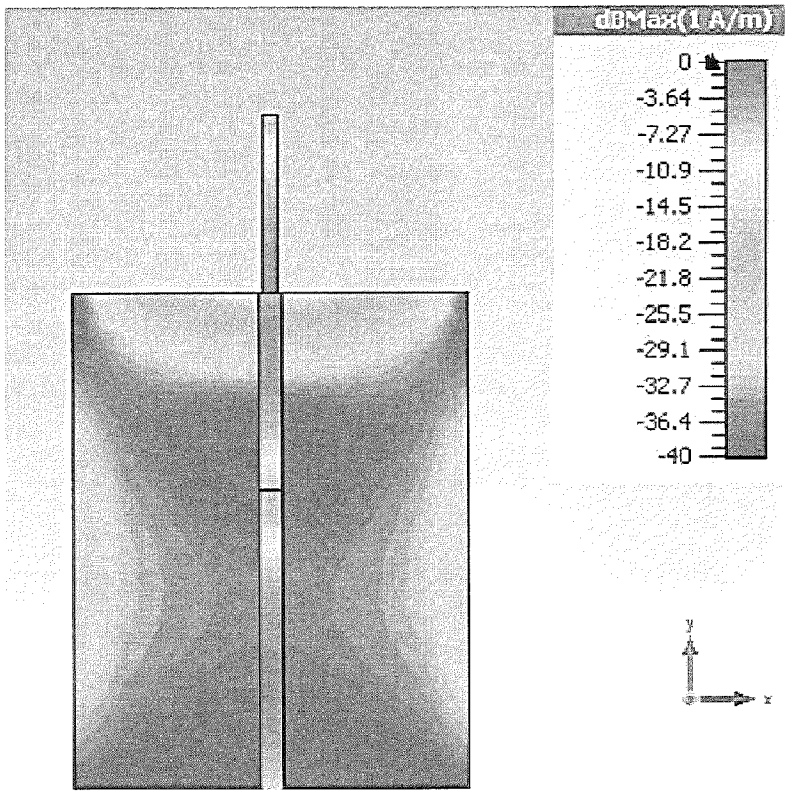
FIG. 4D illustrates the current distribution for the monopole antenna of FIG. 4A.

Turning now to FIG. 4A, a monopole antenna 402 is shown as being fed by a microstrip line 404. The operation of the antenna 402/microstrip line 404 may take place at one or more frequencies, such as at 60 GHz As shown in FIG. 4B, the monopole 402 may have a bandwidth of approximately 13 GHz and a good match around 60 GHz. However, the radiation pattern shown in FIG. 4C may be "backward", which may be due to currents flowing along the ground 438 and the microstrip 404 not being well-balanced with the monopole current (FIG. 4D). The total current flowing on the ground 438 and microstrip line 404 may contribute more to the radiation pattern than the monopole 402.

Figure 5A:
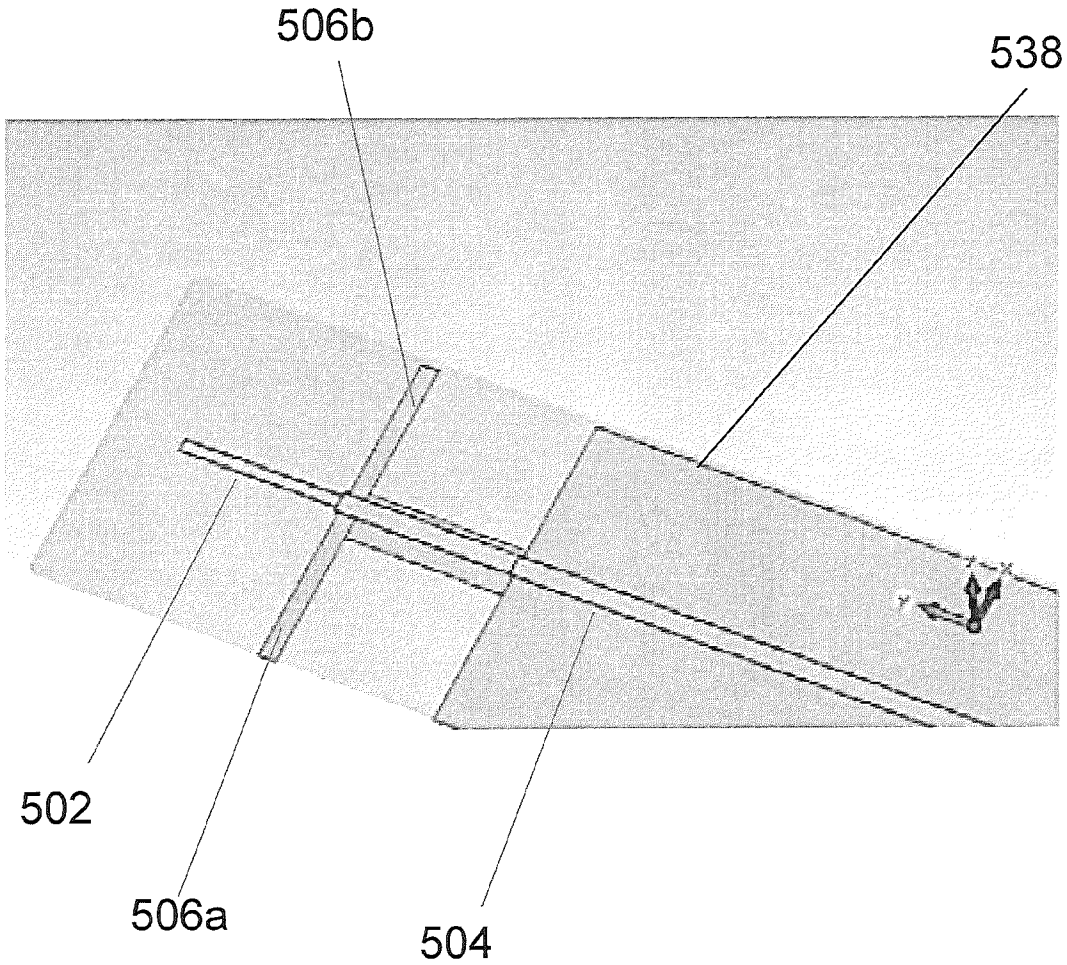
FIG. 5A illustrates a monopole antenna with two straight arms formed in the ground under it.

Turning now to FIG. 5A, a monopole antenna 502 is shown as being fed by a microstrip line 504. The operation of the antenna 502/microstrip line 504 may be similar to the operation of the antenna 402/microstrip line 404.

As shown in FIG. 5A, two straight arms 506*a* and 506*b* may be formed in the ground 538 located below the antenna 502. The arms 506*a* and 506*b* may be used to force the currents flowing on the ground plane 538 to them, thereby reducing the current that may cause backward radiation. This is because the current flowing in these arms would be equal but in opposite directions.

Figure 5B:
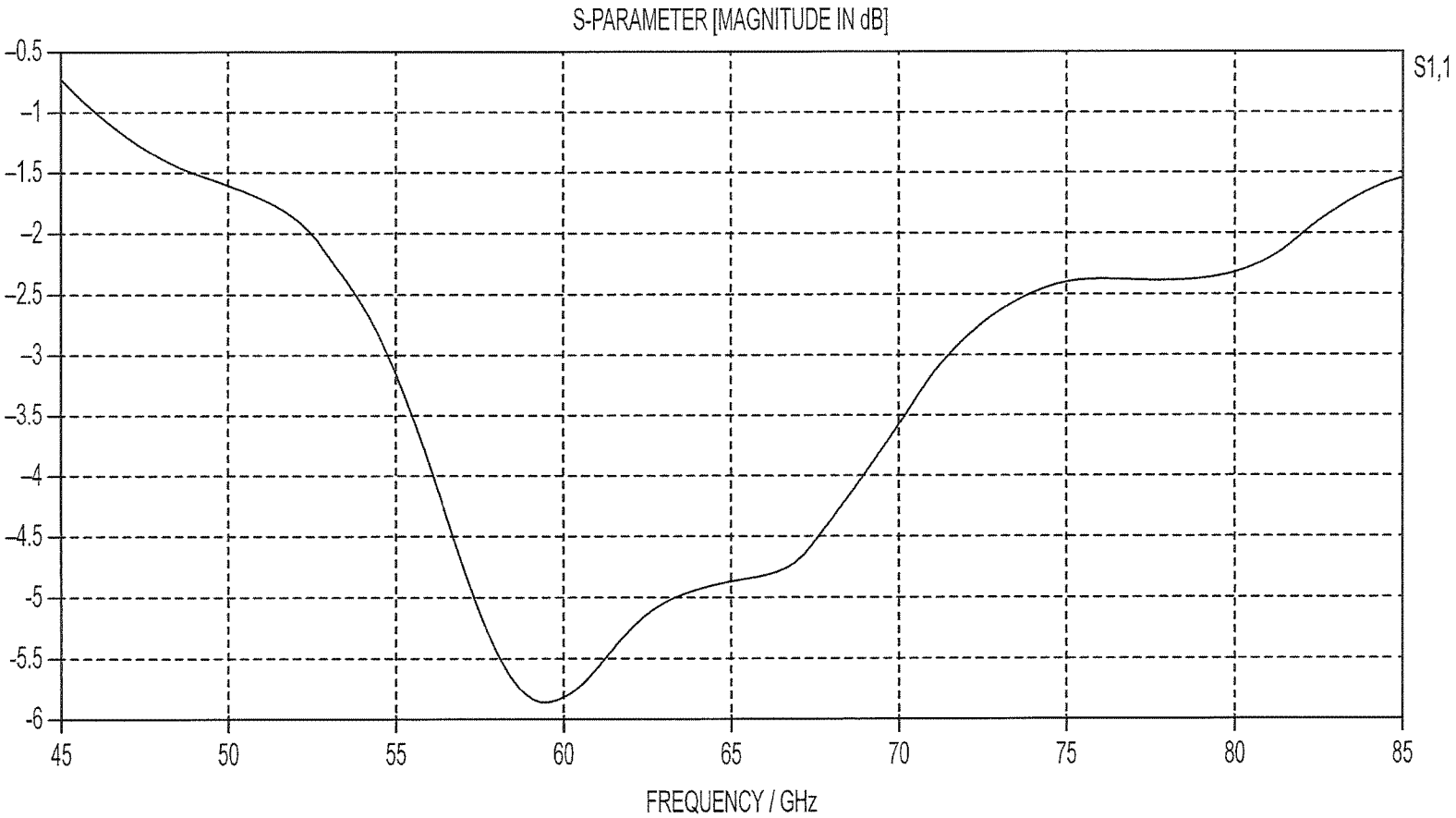
FIG. 5B illustrates a S11 reflection coefficient for the monopole antenna of FIG. 5A.
Figure 5C:
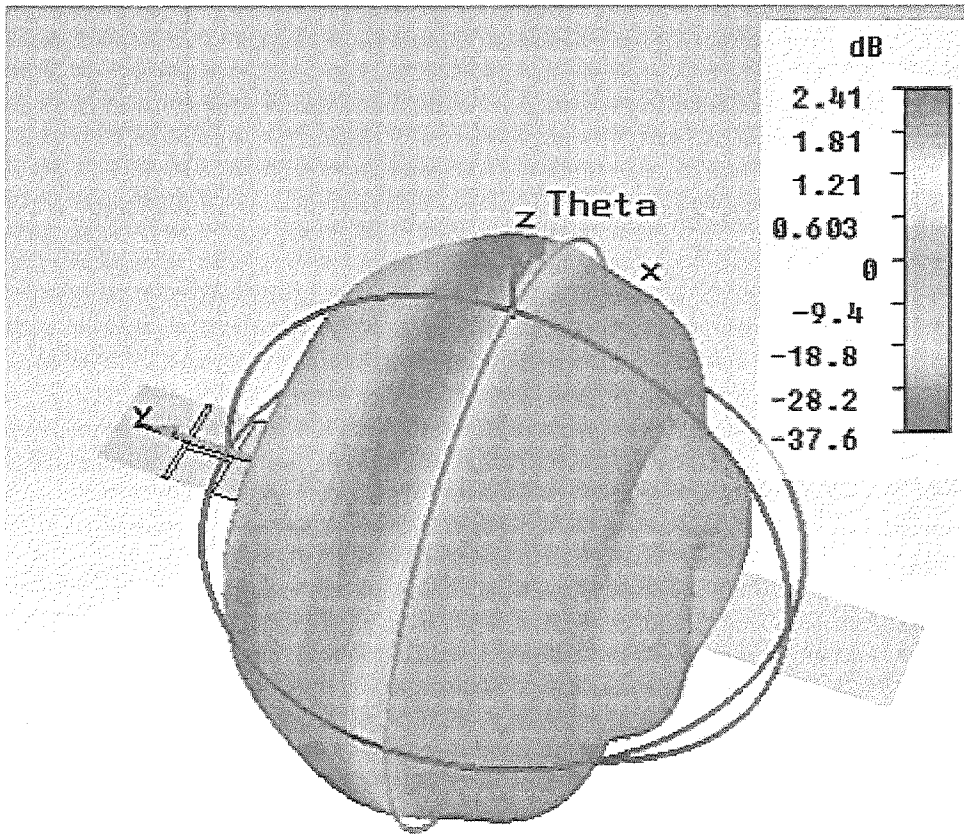
FIG. 5C illustrates a 3D radiation pattern for the monopole antenna of FIG. 5A.
Figure 5D:
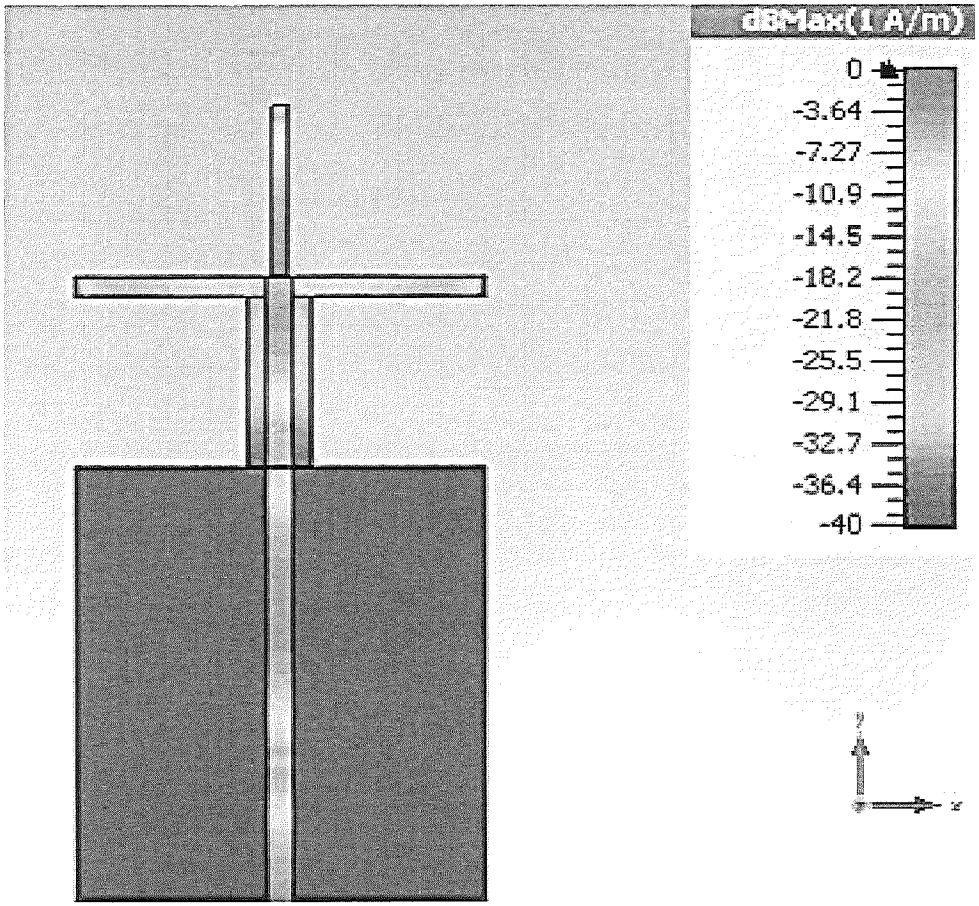
FIG. 5D illustrates the current distribution for the monopole antenna of FIG. 5A.

The S11/reflection coefficient performance for the antenna 502 is shown in FIG. 5B. The 3D radiation pattern and current distribution for the antenna 502 are shown in FIGS. 5C and 5D. The antenna 502 might not have as good a matching as the antenna 402; however, the current may be more balanced. The 3D radiation pattern for the antenna 502 may be more omnidirectional relative to the 3D radiation pattern for the antenna 402.

Figure 6A:
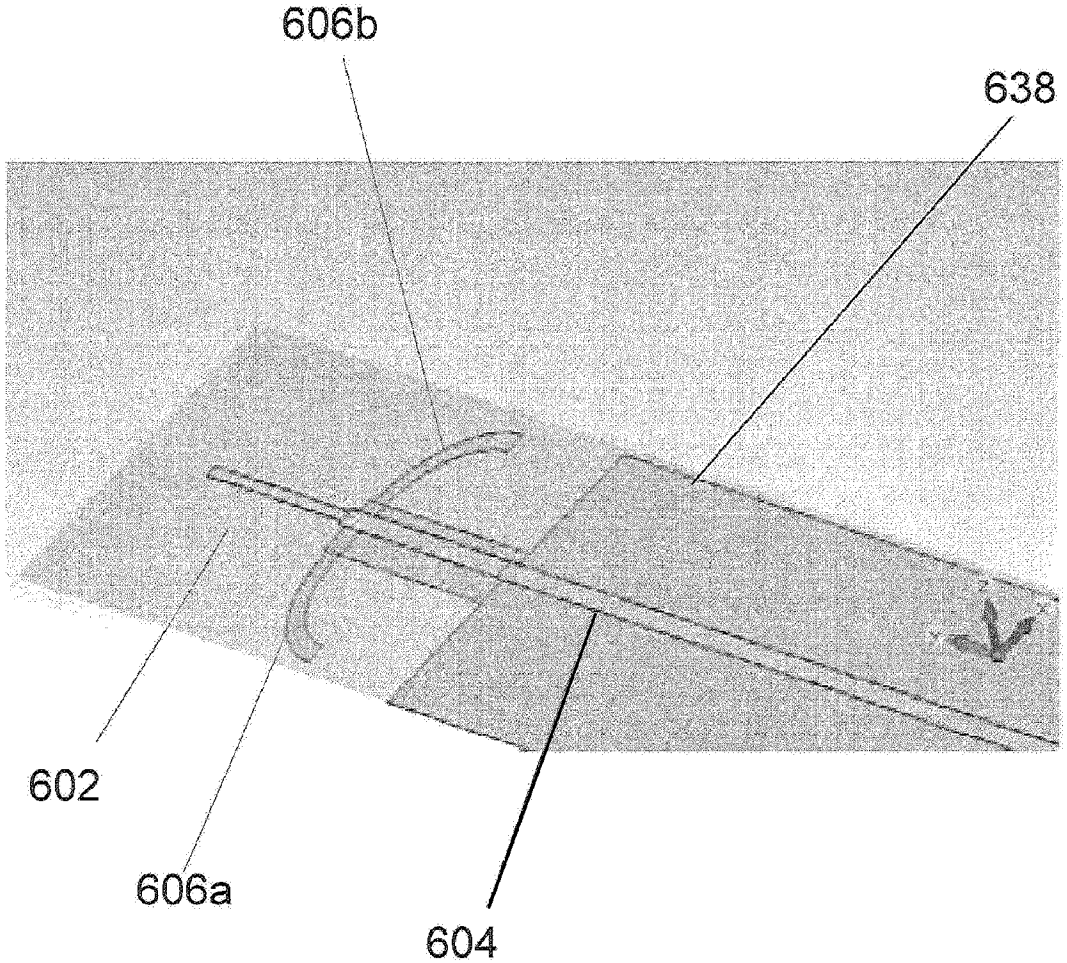
FIG. 6A illustrates a monopole antenna with two curved arms formed in the ground under it.

Turning now to FIG. 6A, a monopole antenna 602 is shown as being fed by a microstrip line 604. The operation of the antenna 602/microstrip line 604 may be similar to the operation of the antenna 502/microstrip line 504.

Figure 6B:
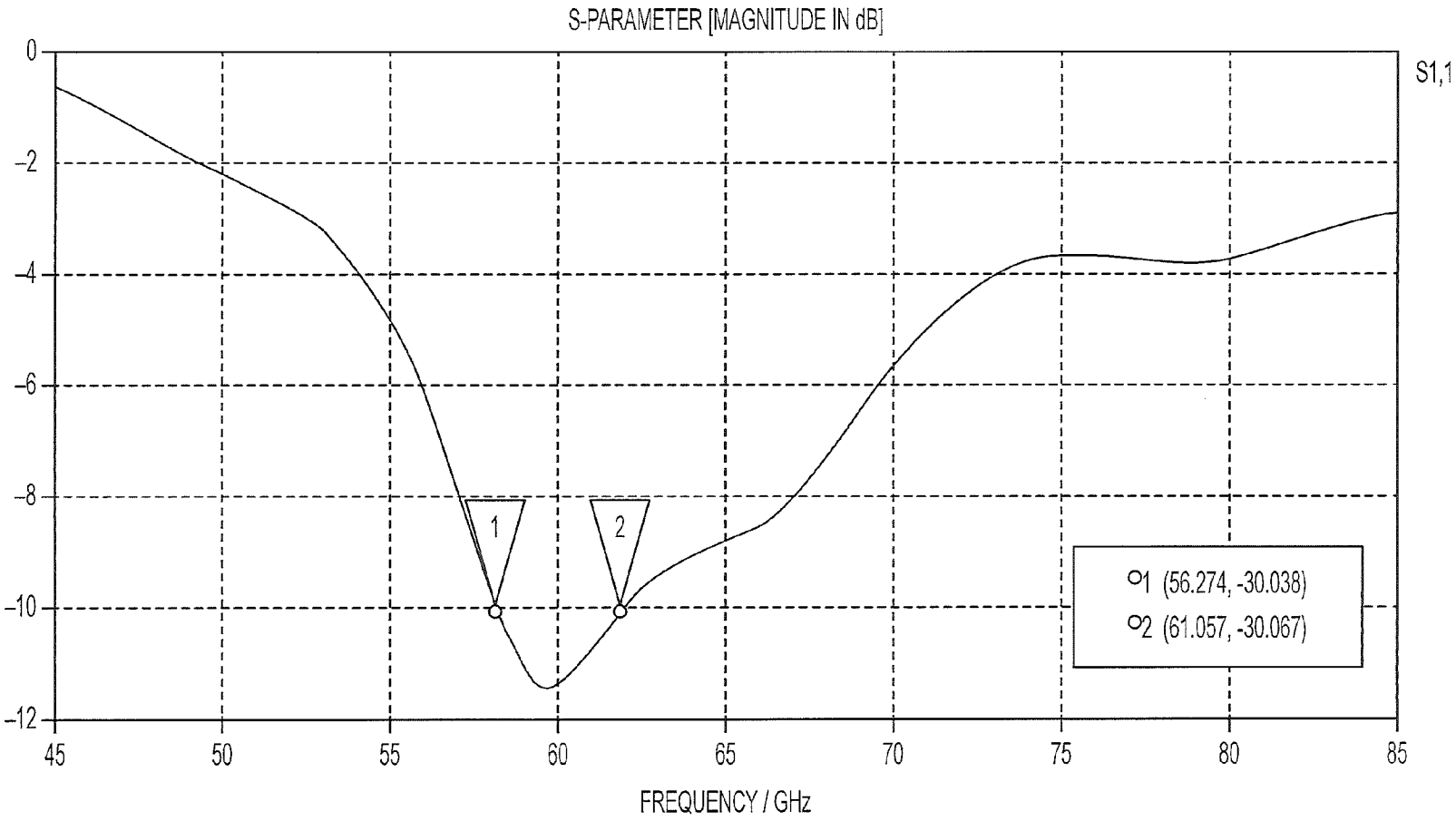
FIG. 6B illustrates a S11 reflection coefficient for the monopole antenna of FIG. 6A.
Figure 6C:
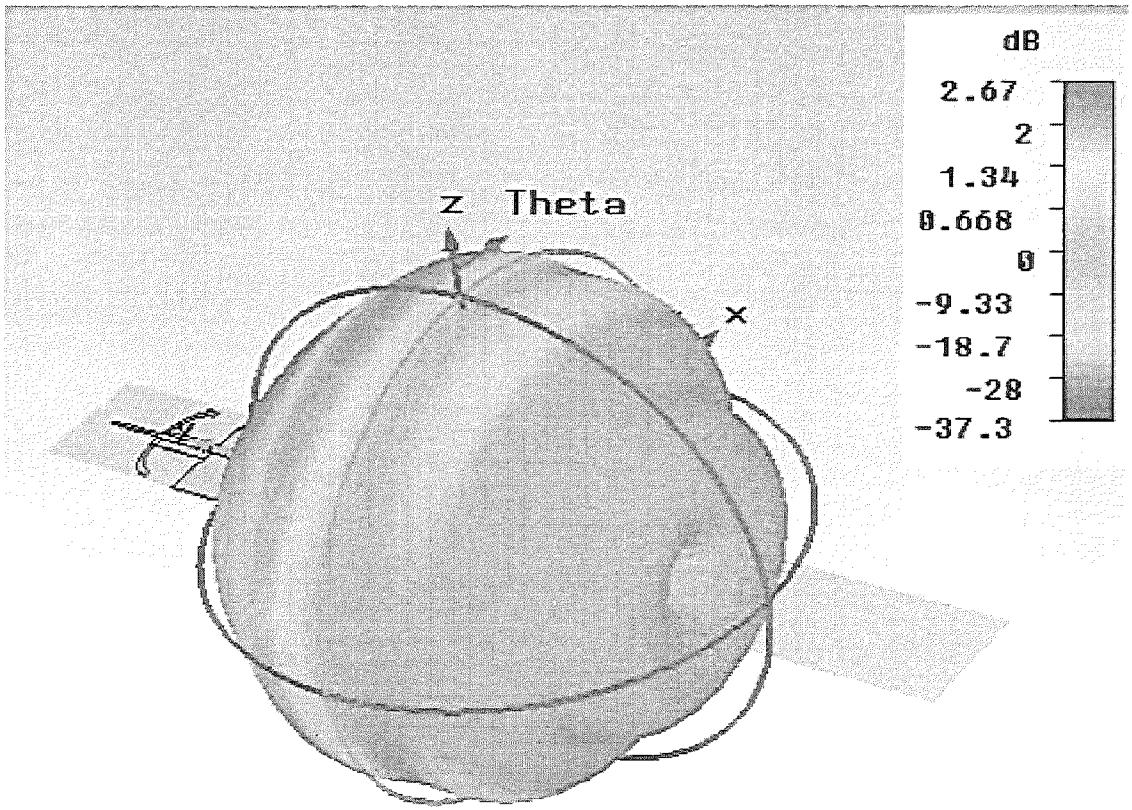
FIG. 6C illustrates a 3D radiation pattern for the monopole antenna of FIG. 6A.
Figure 6D:
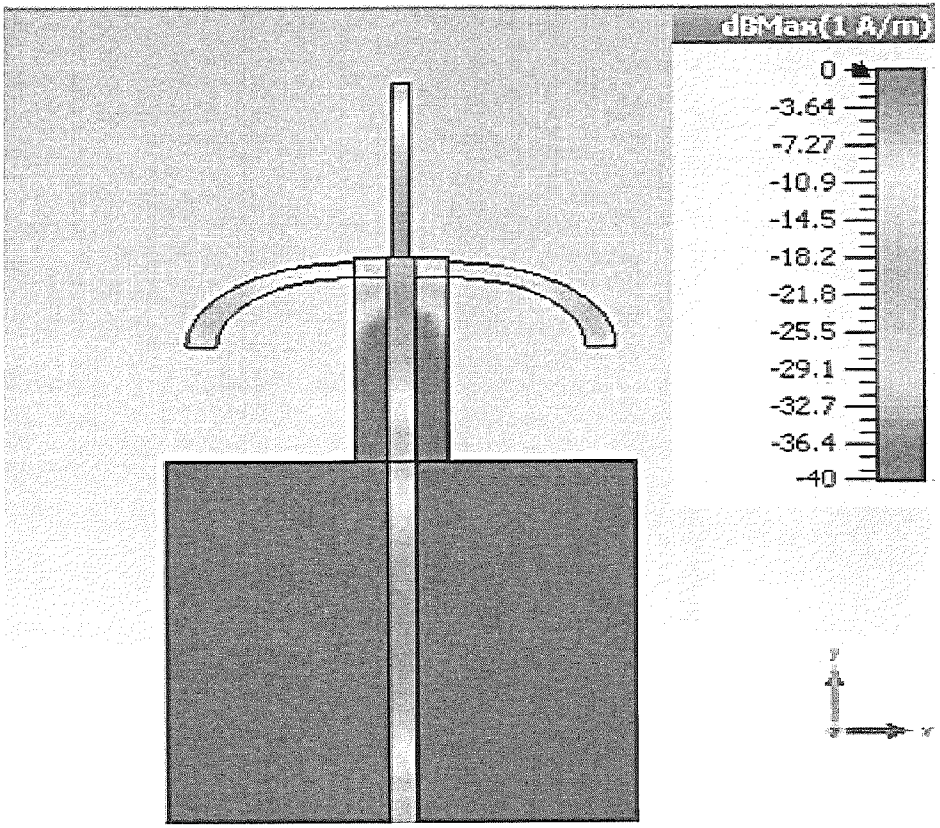
FIG. 6D illustrates the current distribution for the monopole antenna of FIG. 6A.

As shown in FIG. 6A, two curved arms 606*a* and 606*b* may be formed in the ground 638 located below the antenna 602. The arms 606*a* and 606*b* may be tapered in some embodiments. The use of the curved arms 606*a* and 606*b* may facilitate better antenna matching compared to the use of the straight arms 506*a* and 506*b* in FIG. 5A. As shown in FIGS. 6B-6D, the antenna 602 may have a bandwidth of approximately 3.8 GHz and a good omnidirectional radiation pattern.

Figure 7A:
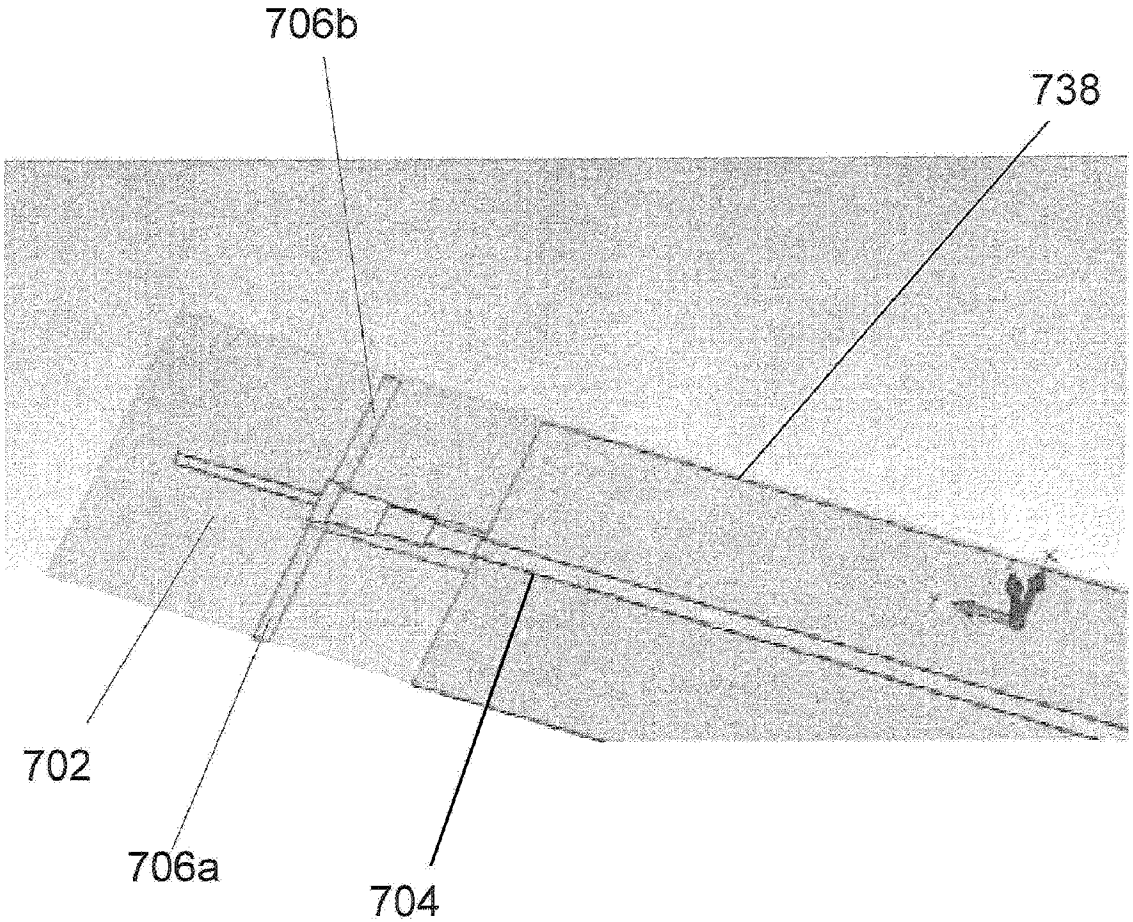
FIG. 7A illustrates a monopole antenna with a stepwise tapered microstrip feed.

Turning now to FIG. 7A, a monopole antenna 702 is shown as being fed by a microstrip line 704. The operation of the antenna 702/microstrip line 704 may be similar to the operation of the antenna 602/microstrip line 604.

The antenna 702 may have arms (e.g., straight arms) 706*a* and 706*b* formed in the ground 738 underneath it.

Figure 7B:
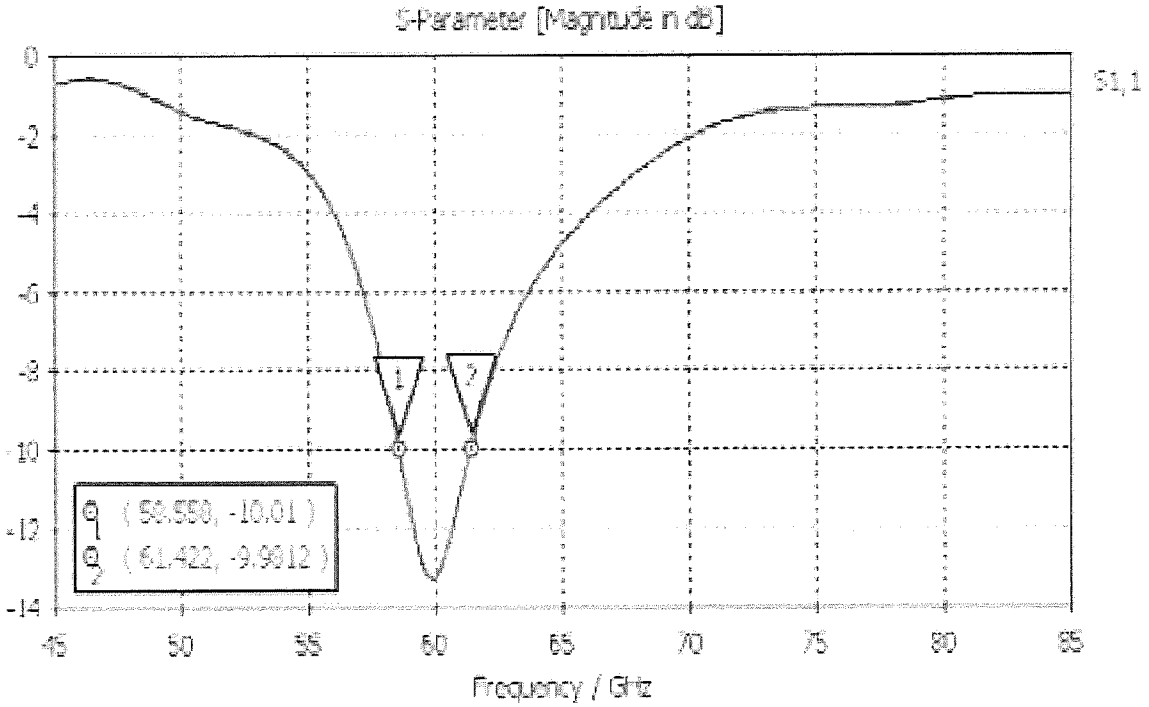
FIG. 7B illustrates a S11 reflection coefficient for the monopole antenna of FIG. 7A.
Figure 7C:
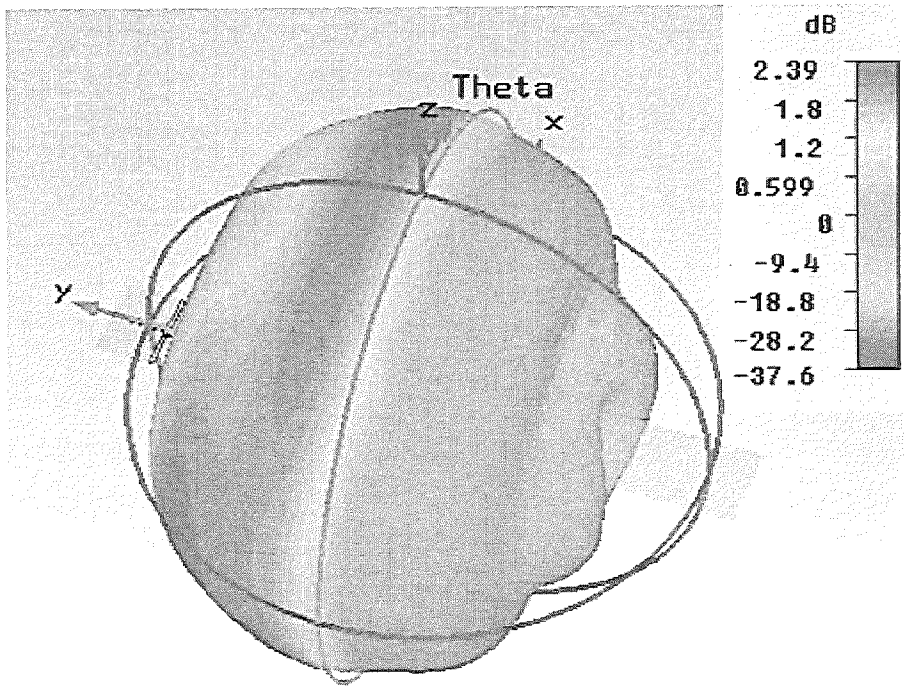
FIG. 7C illustrates a 3D radiation pattern for the monopole antenna of FIG. 7A.
Figure 7D:
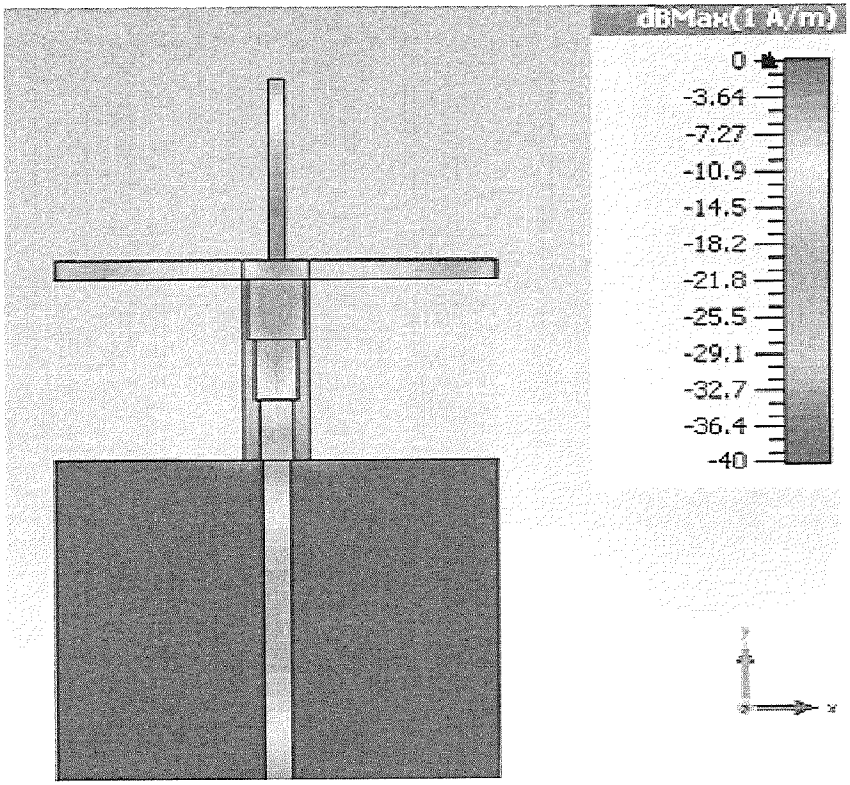
FIG. 7D illustrates the current distribution for the monopole antenna of FIG. 7A.

As shown in FIG. 7A, the microstrip feed 704 may be tapered in a stepwise or staircase manner. As shown in FIGS. 7B-7D, the antenna 702 may have improved matching relative to the antenna 402 of FIG. 4A, the antenna 702 may have a bandwidth of approximately 3 GHz and a good omnidirectional radiation pattern.

Figure 8A:
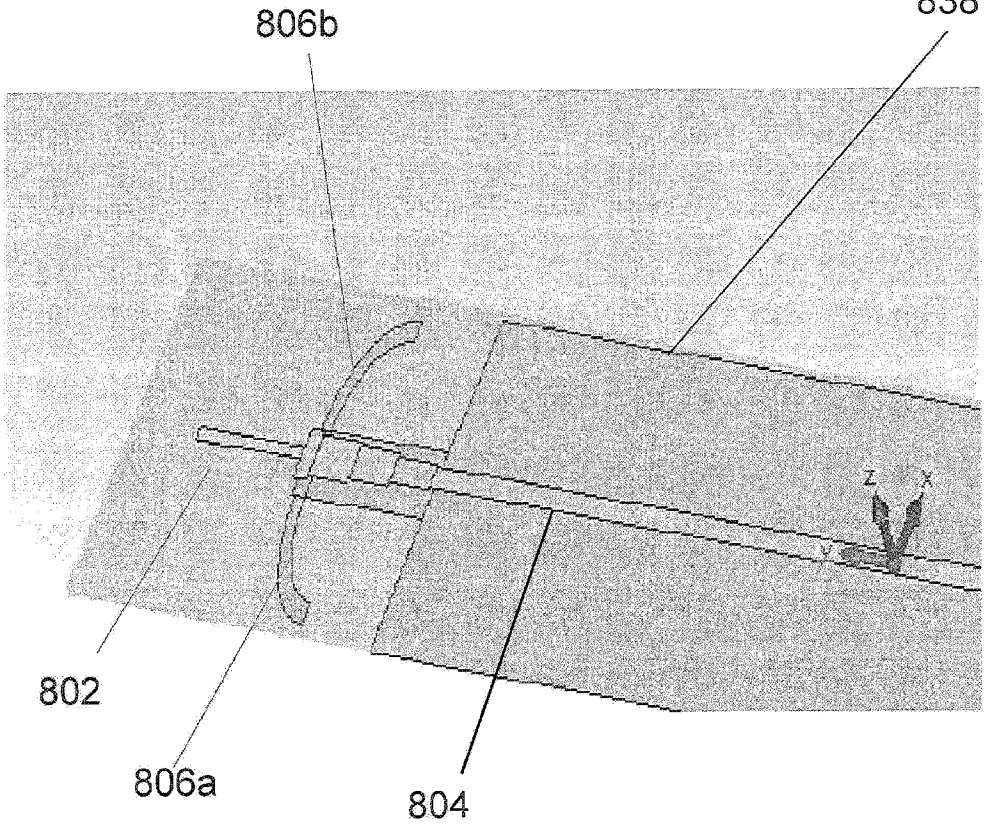
FIG. 8A illustrates a monopole antenna with a stepwise tapered microstrip feed and curved arms in the ground underneath it.

Turning now to FIG. 8A, a monopole antenna 802 is shown as being fed by a microstrip line 804. The operation of the antenna 802/microstrip line 804 may be similar to the operation of the antenna 702/microstrip line 704.

The antenna 802 may have arms (e.g., curved, tapered arms) 806*a* and 806*b* formed in the ground 838 underneath it.

Figure 8B:
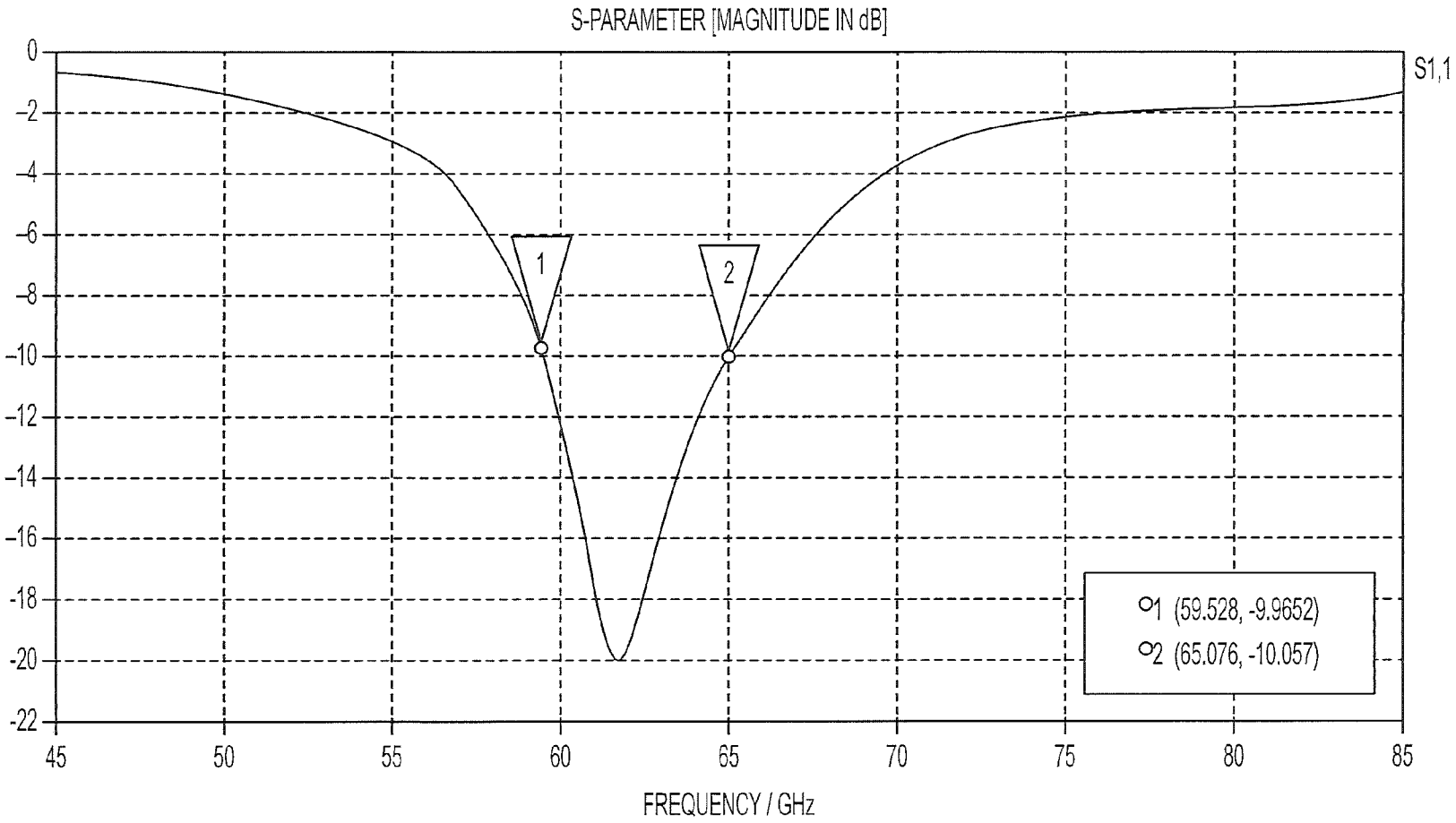
FIG. 8B illustrates a S11 reflection coefficient for the monopole antenna of FIG. 8A.
Figure 8C:
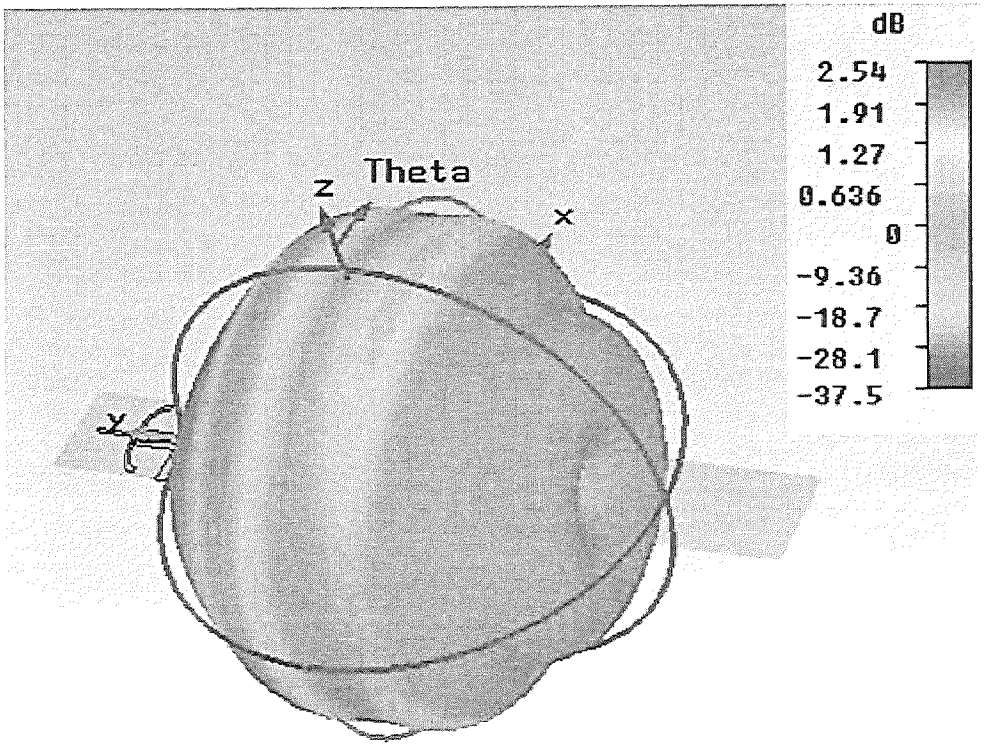
FIG. 8C illustrates a 3D radiation pattern for the monopole antenna of FIG. 8A.
Figure 8D:
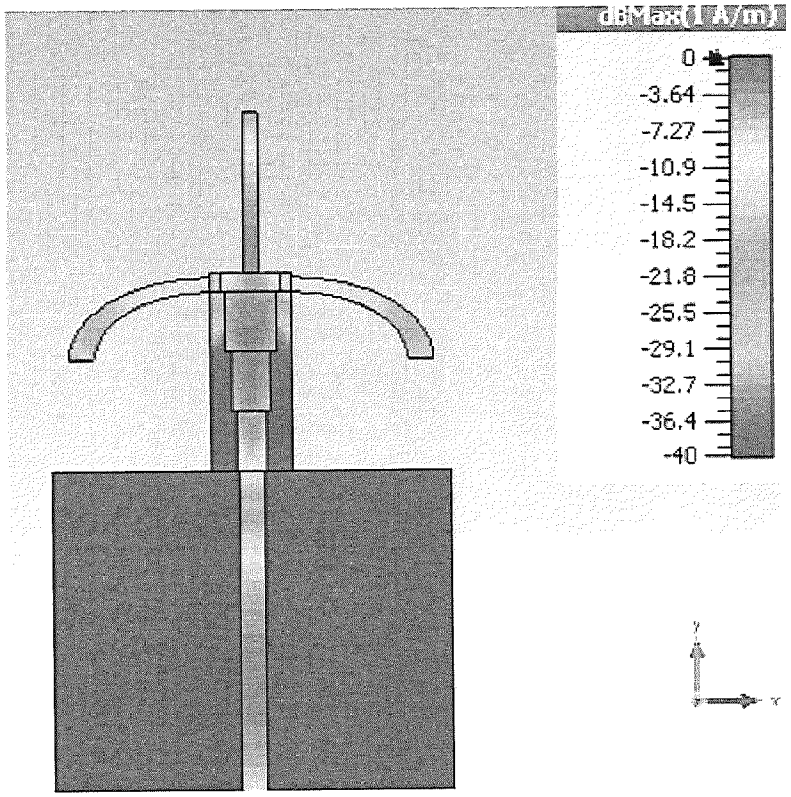
FIG. 8D illustrates the current distribution for the monopole antenna of FIG. 8A.

As shown in FIG. 8A, the microstrip feed 804 may be tapered in a stepwise or staircase manner. As shown in FIGS. 8B-8D, the antenna 802 may have a bandwidth of approximately 5.5 GHz and a good omnidirectional radiation pattern.

Figure 9:
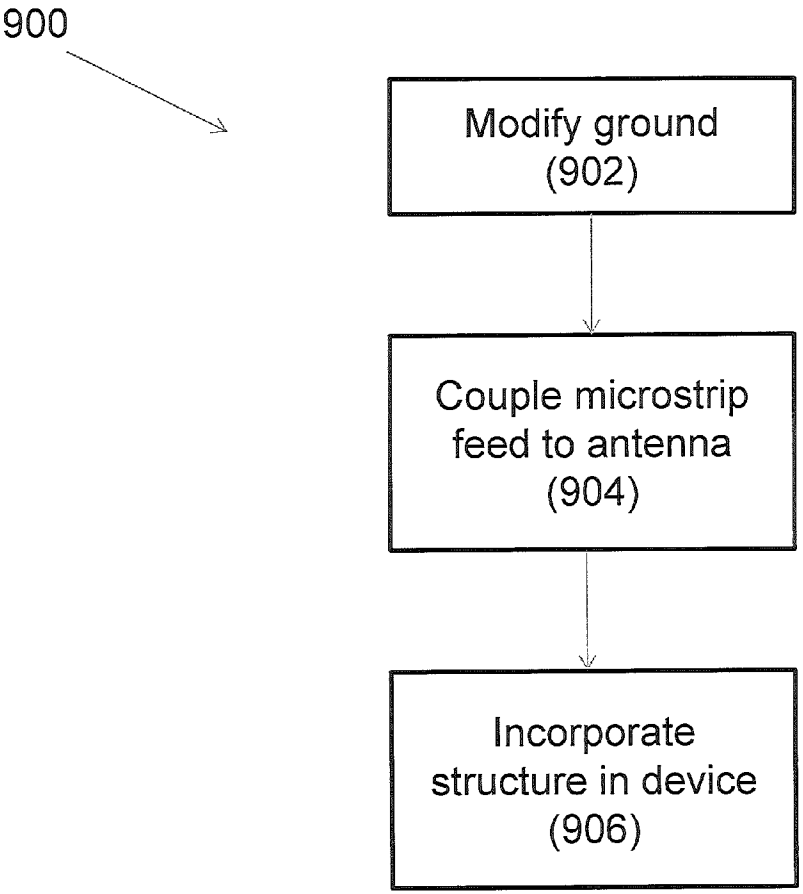
FIG. 9 illustrates a flow chart of an exemplary method.

Turning now to FIG. 9, a flow chart of a method 900 is shown. The method 900 may be used to provide a monopole antenna with a Balun structure that eliminates ground currents that might otherwise cause backward radiation.

In block 902, a ground or ground plane may be modified. For example, the modification may include a number (e.g., two) arms. The arms may take one or more shapes (e.g., straight or curved). The arms may be tapered in some embodiments. The arms may force current to flow in equal but opposite directions.

In block 904, a microstrip feed may be coupled to the antenna. The microstrip feed may be tapered as it couples to the antenna. The microstrip feed may couple to the antenna using one or more shapes, such as a step or staircase.

In block 906, the monopole antenna/Balun structure may be incorporated into one or more devices, such as a mobile device. The mobile device may be configured to operate at one or more frequencies, such as at 60 GHz.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments of the disclosure may be implemented using one or more technologies. In some embodiments, an apparatus or system may include one or more processors, and memory storing instructions that, when executed by the one or more processors, cause the apparatus or system to perform one or more methodological acts, such as those described herein. Various mechanical components known to those of skill in the art may be used in some embodiments.

Embodiments of the disclosure may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., an apparatus or system) to perform one or more methodological acts, such as those described herein. In some embodiments, the functionality described herein may be implemented in hardware, software, firmware, or any combination thereof.

The particular embodiments disclosed above are illustrative only and should not be taken as limitations upon the present disclosure, as the disclosure may be modified and practiced in different but equivalent manners apparent to those skilled in the art having the benefit of the teachings herein. Accordingly, the foregoing description is not intended to limit the disclosure to the particular form set forth, but on the contrary, is intended to cover such alternatives, modifications and equivalents as may be included within the spirit and scope of the disclosure as defined by the appended claims so that those skilled in the art should understand that they can make various changes, substitutions and alterations without departing from the spirit and scope of the disclosure in its broadest form.

What is claimed is:

1. An antenna structure comprising:

a monopole antenna located in a first plane;

a microstrip coupled to the monopole antenna and located in the first plane; and a ground plane located in a second plane parallel to the first plane and comprising a balun structure having at least two arms disposed symmetrically in the second plane beneath the microstrip and perpendicular to the monopole antenna, wherein the monopole antenna does not overlap the at least two arms, wherein the at least two arms are disposed symmetrically beneath the microstrip and perpendicular to the monopole antenna such that a position of a first of the at least two arms is a reflection of a position of a second of the at least two arms about a central axis of a length direction of the monopole antenna, wherein the monopole antenna is a rod-shaped antenna that extends linearly along the central axis, and wherein the at least two arms are configured to force current flowing on the ground plane into the at least two arms to reduce current available for causing backward radiation.

2. The antenna structure of claim 1, wherein the at least two arms are straight.

3. The antenna structure of claim 1, wherein the at least two arms are curved.

4. The antenna structure of claim 1, wherein the at least two arms are tapered such that a narrow portion of the taper couples to the ground plane.

5. The antenna structure of claim 1, wherein the microstrip couples to the monopole antenna using a stepwise tapered microstrip feed.

6. The antenna structure of claim 1, wherein the antenna structure is implemented in a mobile device.

7. An antenna structure comprising:

a monopole antenna located in a first plane;

a microstrip located in the first plane and coupled to the monopole antenna using a stepwise tapered microstrip feed; and a balun structure located in a second plane positioned parallel to the first plane and having a plurality of arms disposed symmetrically beneath the microstrip and perpendicular to the monopole antenna, wherein the monopole antenna does not overlap at least two of the plurality of arms, wherein the at least two arms are disposed symmetrically beneath the microstrip and perpendicular to the monopole antenna such that a position of a first of the at least two arms is a reflection of a position of a second of the at least two arms about a central axis of a length direction of the monopole antenna, wherein the monopole antenna is a rod-shaped antenna that extends linearly along the central axis, and wherein the at least two arms are configured to force current flowing on a ground plane into the at least two arms to reduce current available for causing backward radiation.

8. The antenna structure of claim 7, wherein the ground plane is modified to include the at least two arms.

9. The antenna structure of claim 8, wherein the at least two arms are straight.

10. The antenna structure of claim 8, wherein the at least two arms are curved.

11. The antenna structure of claim 8, wherein the at least two arms are tapered such that a narrow portion of the taper couples to the ground plane.

12. The antenna structure of claim 7, wherein the antenna structure is implemented in a mobile device.

13. A method comprising:

modifying a ground plane of a microstrip to include at least two arms; and coupling the microstrip to a monopole antenna, wherein the at least two arms comprise a balun structure disposed symmetrically beneath the microstrip and perpendicular to the monopole antenna, wherein the monopole antenna and microstrip are located in a first plane, and wherein the ground plane and the at least two arms that comprise the balun structure are located in a second plane that is positioned parallel to the first plane, wherein the monopole antenna does not overlap the at least two arms, wherein the at least two arms are disposed symmetrically beneath the microstrip and perpendicular to the monopole antenna such that a position of a first of the at least two arms is a reflection of a position of a second of the at least two arms about a central axis of a length direction of the monopole antenna, wherein the monopole antenna is a rod-shaped antenna that extends linearly along the central axis, and wherein the at least two arms are configured to force current flowing on the ground plane into the at least two arms to reduce current available for causing backward radiation.

14. The method of claim 13, wherein the at least two arms are straight.

15. The method of claim 13, wherein the at least two arms are curved.

16. The method of claim 13, wherein the at least two arms are tapered such that a narrow portion of the taper couples to the ground plane.

17. The method of claim 13, wherein the microstrip couples to the monopole antenna using a stepwise tapered microstrip feed.

18. The method of claim 13, further comprising:

implementing the modified microstrip and monopole antenna in a mobile device.

19. The method of claim 18, wherein the mobile device is configured to operate at 60 GHz.

* * * * *